US008655220B2

(12) United States Patent
Iwasaki et al.

(10) Patent No.: US 8,655,220 B2
(45) Date of Patent: Feb. 18, 2014

(54) ELECTROPHOTOGRAPHIC PHOTORECEPTOR, PROCESS CARTRIDGE AND IMAGE FORMING APPARATUS

(75) Inventors: Masahiro Iwasaki, Kanagawa (JP); Katsumi Nukada, Kanagawa (JP); Wataru Yamada, Kanagawa (JP); Kenta Ide, Kanagawa (JP); Hirofumi Nakamura, Kanagawa (JP); Mitsuhide Nakamura, Kanagawa (JP); Koji Bando, Kanagawa (JP); Kaori Iemula, Kanagawa (JP); Kazuya Hongo, Kanagawa (JP); Yasuhiro Nida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 955 days.

(21) Appl. No.: 12/247,794

(22) Filed: Oct. 8, 2008

(65) Prior Publication Data

US 2009/0238602 A1 Sep. 24, 2009

(30) Foreign Application Priority Data

Mar. 19, 2008 (JP) ..... 2008-071840

(51) Int. Cl.
*G03G 21/18* (2006.01)

(52) U.S. Cl.
USPC ..... 399/111; 399/159; 430/69; 430/60

(58) Field of Classification Search
USPC ..... 430/69, 60; 399/111, 159
See application file for complete search history.

(56) References Cited

U.S. PATENT DOCUMENTS

| | | | |
|---|---|---|---|
| 4,818,650 | A | 4/1989 | Limburg et al. |
| 4,956,440 | A | 9/1990 | Limburg et al. |
| 5,283,145 | A | 2/1994 | Nukada et al. |
| 5,290,928 | A | 3/1994 | Nukada et al. |
| 5,298,617 | A | 3/1994 | Nukada et al. |
| 5,302,479 | A | 4/1994 | Daimon et al. |
| 5,308,728 | A | 5/1994 | Imai et al. |
| 5,338,636 | A | 8/1994 | Nukada et al. |

(Continued)

FOREIGN PATENT DOCUMENTS

| | | | |
|---|---|---|---|
| CN | 101196697 | A | 6/2008 |
| EP | 0 377 998 | A2 | 7/1990 |

(Continued)

OTHER PUBLICATIONS

Japanese Office Action issued in Application No. 2008-071840; Dated Jun. 28, 2010 (With Translation).

(Continued)

*Primary Examiner* — Mark F Huff
*Assistant Examiner* — Rachel Zhang
(74) *Attorney, Agent, or Firm* — Oliff PLC

(57) ABSTRACT

An electrophotographic photoreceptor including a conductive substrate and a photosensitive layer provided on a surface of the conductive substrate, an outermost layer of the photosensitive layer containing a crosslinked product formed from at least one charge transporting material having at least one substituent selected from the group consisting of —OH, —$OCH_3$, —$NH_2$, —SH, and —COOH and at least one selected from a guanamine compound or a melamine compound, the content of the at least one charge transporting material being at least about 90% by weight, and the content of the at least one selected from the guanamine compound or the melamine compound being from about 0.1% by weight to about 5% by weight.

14 Claims, 4 Drawing Sheets

(56) References Cited

U.S. PATENT DOCUMENTS

| | | | | |
|---|---|---|---|---|
| 5,358,813 | A | 10/1994 | Iijima et al. | |
| 5,378,569 | A | 1/1995 | Nukada et al. | |
| 5,393,629 | A | 2/1995 | Nukada et al. | |
| 5,416,207 | A | 5/1995 | Imai et al. | |
| 5,456,989 | A | 10/1995 | Nogami et al. | |
| 5,459,004 | A | 10/1995 | Daimon et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 5,932,384 | A | 8/1999 | Mitsumori et al. | |
| 6,180,303 | B1 | 1/2001 | Uematsu et al. | |
| 6,489,069 | B1 | 12/2002 | Itami et al. | |
| 6,555,279 | B2 | 4/2003 | Nakata et al. | |
| 6,829,454 | B2 | 12/2004 | Miyakawa et al. | |
| 7,302,210 | B2 | 11/2007 | Fukushima et al. | |
| 7,384,717 | B2 | 6/2008 | Dinh et al. | |
| 2001/0031412 | A1 | 10/2001 | Itami et al. | |
| 2002/0106570 | A1 | 8/2002 | Kami et al. | |
| 2002/0119382 | A1 | 8/2002 | Nakata et al. | |
| 2003/0129512 | A1* | 7/2003 | Sugino et al. | 430/66 |
| 2003/0194625 | A1 | 10/2003 | Tanaka et al. | |
| 2004/0063014 | A1 | 4/2004 | Yoshimura et al. | |
| 2005/0026058 | A1 | 2/2005 | Kami et al. | |
| 2005/0181291 | A1 | 8/2005 | Kami et al. | |
| 2006/0093931 | A1 | 5/2006 | Itami | |
| 2006/0199092 | A1 | 9/2006 | Sugino et al. | |
| 2007/0065741 | A1* | 3/2007 | Iemura et al. | 430/60 |
| 2007/0077506 | A1 | 4/2007 | Kihara et al. | |
| 2007/0148570 | A1 | 6/2007 | Iwasaki et al. | |
| 2008/0026308 | A1* | 1/2008 | Qi et al. | 430/58.4 |
| 2008/0089712 | A1 | 4/2008 | Nukada et al. | |
| 2008/0107980 | A1 | 5/2008 | De Jong et al. | |
| 2009/0004583 | A1* | 1/2009 | Nukada et al. | 430/58.5 |
| 2009/0067874 | A1 | 3/2009 | Hoshio | |
| 2009/0117476 | A1 | 5/2009 | Heuft et al. | |
| 2010/0167193 | A1 | 7/2010 | Nukada et al. | |

FOREIGN PATENT DOCUMENTS

| | | | |
|---|---|---|---|
| EP | 0 710 893 | A1 | 5/1996 |
| EP | 1 211 565 | A1 | 6/2002 |
| EP | 1 600 822 | A2 | 11/2005 |
| EP | 1 808 732 | A1 | 7/2007 |
| EP | 2 202 582 | A1 | 6/2010 |
| EP | 2 233 979 | A1 | 9/2010 |
| JP | A-56-51749 | | 5/1981 |
| JP | A-60-247647 | | 12/1985 |
| JP | A-62-251757 | | 11/1987 |
| JP | A-64-1728 | | 1/1989 |
| JP | A-02-255856 | | 10/1990 |
| JP | A-04-189873 | | 7/1992 |
| JP | A-4-281461 | | 10/1992 |
| JP | A-5-43823 | | 2/1993 |
| JP | A-05-098181 | | 4/1993 |
| JP | A-05-099737 | | 4/1993 |
| JP | A-05-140472 | | 6/1993 |
| JP | A-05-140473 | | 6/1993 |
| JP | A-05-263007 | | 10/1993 |
| JP | A-05-279591 | | 10/1993 |
| JP | A-07-146564 | | 6/1995 |
| JP | A-08-176293 | | 7/1996 |
| JP | A-08-208820 | | 8/1996 |
| JP | A-8-278645 | | 10/1996 |
| JP | A-2000-019749 | | 1/2000 |
| JP | A-2000-066424 | | 3/2000 |
| JP | A-2000-292959 | | 10/2000 |
| JP | A-2001-201876 | | 7/2001 |
| JP | A-2001-255685 | | 9/2001 |
| JP | A-2002-006524 | | 1/2002 |
| JP | A-2002-82469 | | 3/2002 |
| JP | A-2002-082469 | | 3/2002 |
| JP | B2-3287678 | | 3/2002 |
| JP | A-2003-084474 | | 3/2003 |
| JP | A-2003-186222 | | 7/2003 |
| JP | A-2003-186234 | | 7/2003 |
| JP | A-2004-004454 | | 1/2004 |
| JP | A-2005-062830 | | 3/2005 |
| JP | A-2005-107401 | | 4/2005 |
| JP | A-2005-195961 | | 7/2005 |
| JP | A-2005-234081 | | 9/2005 |
| JP | A-2005-234140 | | 9/2005 |
| JP | A-2005-234546 | | 9/2005 |
| JP | A-2006-084711 | | 3/2006 |
| JP | A-2006-267652 | | 10/2006 |
| JP | A-2006-276103 | | 10/2006 |
| JP | A-2007-086209 | | 4/2007 |
| JP | A-2007-155874 | | 6/2007 |
| JP | A-2007-188051 | | 7/2007 |

OTHER PUBLICATIONS

Jun. 5, 2013 Office Action issued in U.S. Appl. No. 12/623,916.
May 10, 2013 Office Action issued in U.S. Appl. No. 12/049,718.
Apr. 24, 2012 Office Action issued in Chinese Patent Application No. 200910253353.1 (with translation).
Oct. 7, 2011 Search Report issued in European Patent Application No. 10156225.4.
Apr. 13, 2010 Office Action issued in Japanese Patent Application No. 2007-328748 (with translation).
Oct. 26, 2010 Search Report in European Patent Application No. 10155500.1.
Jikken Kagaku Kohza, "Experimental Chemical Lecture", 4th Edition, vol. 28, pp. 430-431 (with translation).
Jun. 7, 2012 Office Action issued in U.S. Appl. No. 12/627,723.
Jan. 9, 2012 Office Action issued in U.S. Appl. No. 12/627,723.
Dec. 3, 2012 Office Action issued in U.S. Appl. No. 12/049,718.
Jun. 12, 2012 Office Action issued in U.S. Appl. No. 12/049,718.
Jan. 13, 2012 Office Action issued in U.S. Appl. No. 12/049,718.
Sep. 12, 2011 Office Action issued in U.S. Appl. No. 12/049,718.
Apr. 26, 2011 Office Action issued in U.S. Appl. No. 12/049,718.
Dec. 10, 2010 Office Action issued in U.S. Appl. No. 12/049,718.
Dec. 3, 2012 Office Action issued in U.S. Appl. No. 12/623,916.
Jun. 21, 2012 Office Action issued in U.S. Appl. No. 12/623,916.
U.S. Appl. No. 12/623,916 in the name of Nakamura et al. filed Nov. 23, 2009.
U.S. Appl. No. 12/627,723 in the name of Haruyama et al, filed Nov. 30, 2009.
U.S. Appl. No. 12/049,718, filed Mar. 17, 2008 in the name of Nukada et al.
Sep. 3, 2013 Office Action issued in U.S. Appl. No. 12/049,718.

* cited by examiner

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2008-071840 filed Mar. 19, 2008.

BACKGROUND

1. Technical Field

The present invention relates to an electrophotographic photoreceptor, a process cartridge and an image forming apparatus.

2. Related Art

Generally, an electrophotographic image forming apparatus has the following structure and processes. Specifically, an image-formed material is obtained by charging the surface of an electrophotographic photoreceptor by a charging means in order to impart a desired polarity and a potential to the surface; forming an electrostatic latent image on the charged surface of the electrophotographic photoreceptor by selectively discharging the surface and exposing the surface to light in an image-wise manner; developing the latent image by attaching a toner thereto by a developing means to form a toner image; and transferring the toner image onto an image-receiving medium by a transfer means.

Electrophotographic photoreceptors are currently in wide use in the fields of copying machines, laser beam printers and other apparatus, due to such advantages as capability of performing printing at high speed and at high quality. Organic photoreceptors employing an organic photoconductive material have become the mainstream of electrophotographic photoreceptors used in an image forming apparatus, which are more cost effective in production and disposal thereof, as compared with conventionally used electrophotographic photoreceptors employing an inorganic photoconductive material such as selenium, selenium-tellurium alloy, selenium-arsenic alloy, cadmium sulfide, or the like.

A corona charging method utilizing a corona charging device has been conventionally used as a charging method. In recent years, however, a contact charging method, having such advantages as suppressed amounts of ozone production and electricity consumption, has been put to practical application and actively used. In the contact charging method, the surface of an electrophotographic photoreceptor is charged by contacting a conductive member serving as a charging member with the surface of the electrophotographic photoreceptor, or by bringing the conductive member close to the surface of the electrophotographic photoreceptor, and then applying a voltage to the charging member. As the methods of applying a voltage to the charging member, there are a direct current method in which only a direct current voltage is applied, and an alternating current superposition method in which a direct current voltage is applied while superposing an alternating current voltage thereto. The contact charging method has such advantages as downsizing of the apparatus and suppressed generation of harmful gases such as ozone.

As a transfer method, a method of transferring a toner image onto a recording medium via an intermediate transfer member, which is applicable to a wide variety of recording media, has been in wide use in place of a conventionally employed method in which a toner image is directly transferred onto a recording medium.

It is also proposed to provide a protective layer on the surface of an electrophotographic photoreceptor in order to improve the strength of the electrophotographic photoreceptor for preventing deterioration and/or wear of the electrophotographic photoreceptor caused by implementation of a contact charging method, or for preventing occurrence of scratches and/or stabs on the electrophotographic photoreceptor caused by implementation of a direct charging method or the use of an intermediate transfer body, thereby suppressing the amount of electrophotographic photoreceptor leakage (a phenomenon in which an excess local current flows through the electrophotographic photoreceptor).

SUMMARY

According to an aspect of the invention, there is provided an electrophotographic photoreceptor comprising a conductive substrate and a photosensitive layer formed on a surface of the conductive substrate, an outermost layer of the photosensitive layer containing a crosslinked product formed from at least one charge transporting material having at least one substituent selected from the group consisting of —OH, —$OCH_3$, —$NH_2$, —SH, and —COOH and at least one selected from a guanamine compound or a melamine compound, the content of the at least one charge transporting material being at least about 90% by weight, and the content of the at least one selected from the guanamine compound or the melamine compound being from about 0.1% by weight to about 5% by weight.

BRIEF DESCRIPTION OF THE DRAWINGS

Exemplary embodiments of the present invention will be described in detail based on the following figures, wherein.

DETAILED DESCRIPTION

Figure 1:
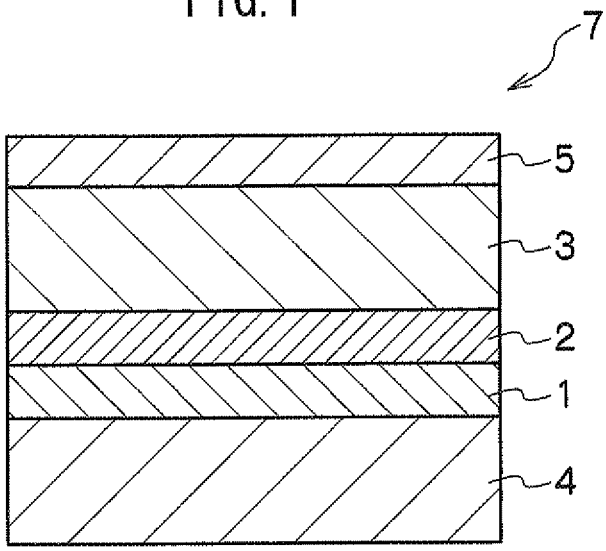
FIG. 1 is a schematic partial cross sectional view showing an electrophotographic photoreceptor according to an exemplary embodiment of the invention.

The electrophotographic photoreceptor of this exemplary embodiment of the invention includes a conductive substrate and a photosensitive layer formed on a surface of the conductive substrate, and an outermost layer of the photosensitive layer contains a crosslinked product formed from at least one charge transporting material having at least one substituent selected from the group consisting of —OH, —$OCH_3$, —$NH_2$, —SH, and —COOH, and at least one selected from a guanamine compound or a melamine compound. The content of the at least one charge transporting material is at least about 90% by weight, and the content of the at least one selected from the guanamine compound or the melamine compound is from about 0.1% by weight to about 5% by weight.

Moreover, the electrophotographic photoreceptor of this exemplary embodiment of the invention includes a conductive substrate and a photosensitive layer formed on a surface of the conductive substrate, and an outermost layer of the photosensitive layer contains a crosslinked product formed from a coating solution containing at least one charge transporting material having at least one substituent selected from the group consisting of —OH, —$OCH_3$, —$NH_2$, —SH, and —COOH, and at least one selected from a guanamine compound or a melamine compound. The solid content concentration of the at least one charge transporting material in the coating solution is at least about 90% by weight, and the solid content concentration of the at least one selected from the guanamine compound or the melamine compound in the coating solution being from about 0.1% by weight to about 5% by weight.

According to the electrophotographic photoreceptor of this exemplary embodiment, having a structure as described above, formation of wrinkles or unevenness may be suppressed even when the thickness of an outermost layer of the electrophotographic photoreceptor is increased, and high mechanical strength of the outermost layer may be maintained. Moreover, the electrophotographic photoreceptor of the invention may exhibit superior resistance properties against ghosting (a phenomenon of forming a residual image due to a recording history of a previously formed image) and against deterioration in electric and image-quality characteristics caused by repeated use over a long term, thereby having an ability of forming an image in a stable manner.

It is presumed that a crosslinking site is multifunctionalized by a guanamine compound or a melamine compound and a charge transporting material having a specific functional group, thereby forming a highly crosslinked film with increased mechanical strength and suppressed variation in electric characteristics due to environmental conditions. By reducing the amount of the guanamine compound or the melamine compound to a level lower than a predetermined amount, and by increasing the amount of the charge transporting material to a level higher than a predetermined amount, as compared with the cases of conventional electrophotographic photoreceptors, a stable image may be obtained by suppressing increase in residual potential in electric characteristics and improving anti-ghosting properties in image quality characteristics, thereby suppressing deterioration in electric and image-quality characteristics while maintaining a highly crosslinked state. Further, by combining a guanamine compound or a melamine compound with a charge transporting material having a specific functional group, wrinkles or unevenness on the surface of the electrophotographic photoreceptor may be suppressed even when the amount of the charge transporting material is increased to more than a predetermined amount, compared with conventional electrophotographic photoreceptors, and even when the thickness of the outermost layer of the photosensitive layer is increased.

For the above reasons, the electrophotographic photoreceptor of the present exemplary embodiment is presumed to achieve the above effects.

In the following, explanation regarding preferable embodiments of the invention will be given with reference to the drawings. In the drawings, elements which are the same or corresponding to each other are indicated by the same reference numerals, and overlapping explanation will be omitted.

(Electrophotographic Photoreceptor)

Figure 2:
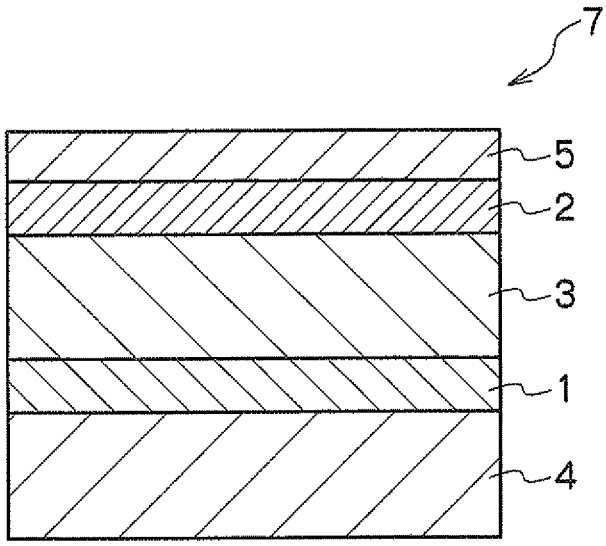
FIG. 2 is a schematic partial cross sectional view showing an electrophotographic photoreceptor according to an exemplary embodiment of the invention.
Figure 3:
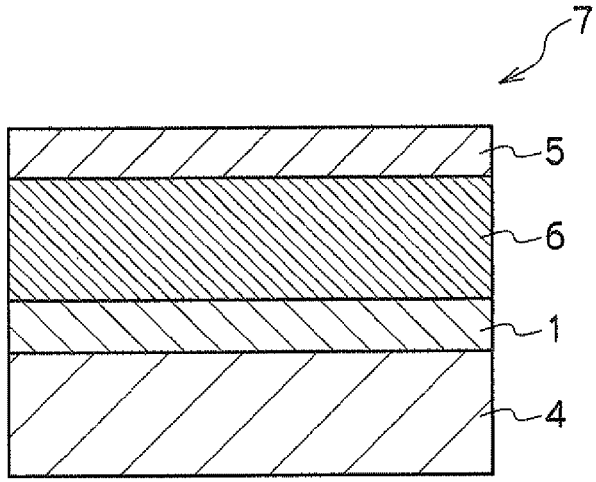
FIG. 3 is a schematic partial cross sectional view showing an electrophotographic photoreceptor according to an exemplary embodiment of the invention.

FIG. 1 is a schematic sectional view showing a preferred exemplary embodiment of the electrophotographic photoreceptor of the invention. FIG. 2 and FIG. 3 are schematic sectional views showing another preferred exemplary embodiment of the electrophotographic photoreceptor of the invention.

In the electrophotographic photoreceptor 7 shown in FIG. 1, an undercoating layer 1 is formed on a conductive substrate 4, and a charge generating layer 2, a charge transport layer 3, and a protective layer 5 are provided in this order on the undercoating layer 1, thereby forming a photosensitive layer.

The electrophotographic photoreceptor 7 shown in FIG. 2 has a photosensitive layer in which a charge generating layer 2 and a charge transport layer 3 each separately functioning from one another, as with the electrophotographic photoreceptor 7 shown in FIG. 1. On the other hand, the electrophotographic photoreceptor 7 shown in FIG. 3 contains a charge generating material and a charge transporting material in a single layer (single-layer photosensitive layer 6 (charge generating/charge transport layer)).

In the electrophotographic photoreceptor 7 shown in FIG. 2, an undercoating layer 1 is provided on a conductive substrate 4, and a charge transport layer 3, a charge generating layer 2, and a protective layer 5 are provided in this order on the undercoating layer 1, thereby forming a photosensitive layer. In the electrophotographic photoreceptor 7 shown in FIG. 3, an undercoating layer 1 is provided on a conductive substrate 4, and a single-layer photosensitive layer 6 and a protective layer 5 are provided in this order on the undercoating layer 1, thereby forming a photosensitive layer.

The protective layers shown in FIG. 1 to FIG. 3 correspond to the outermost layer as described above. In the electrophotographic photoreceptors shown in FIG. 1 to FIG. 3, the undercoating layer may be provided or may not be provided.

In the following, elements included in the electrophotographic photoreceptor 7 shown in FIG. 1 will be further described as a representative example.

<Conductive Substrate>

Examples of the material for conductive substrate 4 include metal plates, metal drums, and metal belts using metals such as aluminum, copper, zinc, stainless steel, chromium, nickel, molybdenum, vanadium, indium, gold, platinum or alloys thereof; and paper, plastic films and belts which are coated, deposited, or laminated with a conductive compound such as a conductive polymer and indium oxide, a metal such as aluminum, palladium and gold, or alloys thereof. The term "conductive" here means that the volume resistivity of the material is less than $10^{13}$ Ωcm.

When the electrophotographic photoreceptor 7 is used in a laser printer, the surface of the conductive substrate 4 is preferably roughened so as to have a centerline average roughness (Ra) of 0.04 μm to 0.5 μm, in order to prevent interference fringes formed upon irradiation with laser light. If Ra is less than 0.04 μm, the surface of the electrophotographic photoreceptor is in a state close to a mirror surface and may not exhibit a satisfactory effect of preventing interference. If Ra exceeds 0.5 μm, image quality tends to be rough even if a film is formed. When incoherent light is used as a light source, surface roughening for the purpose of preventing interference fringes is not necessarily required, and therefore occurrence of defects due to surface irregularities of the conductive substrate 4 can be suppressed, which is desirable for achieving a longer service life.

Preferred examples of the method for surface roughening include wet honing in which a suspension prepared by containing an abrasive in water is sprayed onto a support; centerless grinding in which a support is continuously ground by pressing the support onto a rotating grind stone; and anodic oxidation.

Other preferable methods of surface roughening include a method of forming a layer having a rough surface on the conductive substrate 4 from a resin in which conductive or semiconductive particles are dispersed, namely, obtaining a rough surface of the conductive substrate without subjecting to a roughening treatment.

In the surface-roughening treatment employing anodic oxidation, an oxide film is formed on an aluminum surface by anodic oxidation in an electrolyte solution, using the aluminum as an anode. Examples of the electrolyte solution include a sulfuric acid solution and an oxalic acid solution. However, since the porous anodic oxide film formed by anodic oxidation without any modification is chemically active, the film is prone to be contaminated and variation in resistance thereof due to environmental conditions is large. Therefore, it is preferable to conduct a sealing treatment in which fine pores in the anodic oxide film are sealed by cubical expansion caused by hydration in pressurized water vapor or boiled water (a metallic salt such as a nickel salt may be added thereto) in order to transform the anodic oxide into a more stable hydrated oxide.

The thickness of the anodic oxide film is preferably from 0.3 μm to 15 μm. When the thickness of the anodic oxide film is less than 0.3 μm, barrier properties against the injection may no be enough and sufficient effects may not be achieved. If the thickness of the anodic oxide film exceeds 15 μm, increase in residual potential may be caused due to repeated use.

The conductive substrate 4 may be subjected to a treatment with an acidic aqueous solution or a boehmite treatment. The treatment using an acidic treatment solution containing phosphoric acid, chromic acid and hydrofluoric acid is carried out by preparing an acidic treatment solution and forming a coating layer using the acidic solution. The composition ratio of phosphoric acid, chromic acid and hydrofluoric acid are preferably 10 to 11% by weight of phosphoric acid; 3 to 5% by weight of chromic acid; and 0.5 to 2% by weight of hydrofluoric acid. The total concentration of the acid components is preferably in the range of 13.5 to 18% by weight.

The treatment temperature is preferably 42 to 48° C. By keeping the treatment temperature high, a thicker film can be obtained at a higher speed, compared with the case when a treatment temperature is lower than the above range. The thickness of the film is preferably 0.3 to 15 μm. If the thickness of the film is less than 0.3 μm, barrier properties against the injection may not be enough and sufficient effects may not be achieved. If the thickness exceeds 15 μm, increase in residual potential may be caused due to repeated use.

The boehmite treatment is carried out by immersing the substrate in pure water at a temperature of 90° C. to 100° C. for 5 to 60 minutes, or by contacting the substrate with heated water vapor at a temperature of 90° C. to 120° C. for 5 to 60 minutes. The film thickness is preferably 0.1 to 5 μm. The film may further be subjected to an anodic oxidation treatment using an electrolyte solution which is less capable of dissolving the film, such as solutions of adipic acid, boric acid, borate salt, phosphate, phthalate, maleate, benzoate, tartrate, and citrate, as compared with other chemical species.

<Undercoating Layer>

The undercoating layer 1 includes, for example, a binder resin containing inorganic particles.

The inorganic particles preferably have a powder resistance (volume resistivity) of from $10^2$ Ω·cm to $10^{11}$ ΩQ·cm so that the undercoating layer 1 may obtain adequate resistance in order to achieve enough leak resistance and carrier blocking properties. If the resistance value of the inorganic particles is lower than $10^2$ Ω·cm, adequate leak resistance may not be achieved, and if higher than $10^{11}$ Ω·cm, increase in residual potential may be caused.

Preferred examples of the inorganic particles having a resistance value in the above range include inorganic particles (conductive metal oxide particles) of tin oxide, titanium oxide, zinc oxide and zirconium oxide. Zinc oxide is most preferably used.

The inorganic particles may be subjected to a surface treatment. Two or more kinds of particles which have been subjected to different surface treatments, or having different particle diameters, may be used in combination. The volume average particle size of the inorganic particles is preferably from 50 nm to 2000 nm, and more preferably from 60 nm to 1000 nm.

The inorganic particles preferably have a specific surface area (as measured by a BET method) of 10 $m^2/g$ or more. When the specific surface area thereof is less than 10 $m^2/g$, decrease in electrostatic properties tends to occur and favorable electrophotographic characteristics may not be obtained.

By including inorganic particles and an acceptive compound, the undercoating layer having excellent long-term stability in electrical characteristics and excellent carrier blocking properties may be obtained. Any acceptive compound with which desired characteristics can be obtained may be used, but preferred examples thereof include electron transporting substances such as quinone-based compounds such as chloranil and bromanil, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compounds, and diphenoquinone compounds such as 3,3',5,5'-tetra-t-butyl-diphenoquinone. Among these, compounds having an anthraquinone structure are preferable. Still more preferred examples are acceptive compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin, and purpurin.

The content of the acceptive compound may be determined as appropriate within a range at which desired characteristics can be achieved, but preferably in a range of from 0.01 to 20% by weight with respect to the content of the inorganic particles, and more preferably in a range of 0.05 to 10% by weight, in terms of preventing accumulation of charges and aggregation of inorganic particles. Aggregation of the inorganic particles may cause irregular formation of conductive channels, deterioration in maintainability upon repeated use such as increase in residual potential, and image defects such as black spots as well.

The acceptor compound may be simply added to a solution for forming an undercoating layer, or may be previously attached to the surface of the inorganic particles. There are a dry method and a wet method as the methods of attaching the acceptor compound to the surface of the inorganic particles.

When the surface treatment is conducted according to a dry method, irregular distribution of the acceptor compound can be avoided by adding the acceptor compound, either directly or with an organic solvent, in a dropwise manner to the inorganic particles and spraying the drip of the acceptor compound onto the inorganic particles with dry air or a nitrogen gas while stirring the inorganic particles with a mixer or the like having a high shearing force. The addition or spraying is preferably carried out at a temperature lower than the boiling point of the solvent. If the spraying is carried out at a temperature of not less than the boiling point of the solvent, the solvent may evaporate before the inorganic particles are uniformly stirred and the acceptor compound may coagulate locally, making it difficult to conduct the treatment without irregularities. After the addition or spraying of the acceptor compound, the inorganic particles may further be subjected to baking at a temperature of 100° C. or higher. The baking may be carried out as appropriate at a temperature and a time period at which desired electrophotographic characteristics can be obtained.

When the surface treatment is conducted according to a wet method, the inorganic particles are dispersed in a solvent by means of a stirrer, ultrasonic wave, a sand mill, an attritor, a ball mill or the like. Thereafter, the acceptor compound is added to the inorganic particles and the mixture is further stirred or dispersed, and then the solvent is removed. In this way, the treatment can be conducted without causing variation. The solvent may be removed by filtration or distillation. After removing the solvent, the particles may be subjected to baking at a temperature of 100° C. or higher. The baking may be carried out at any temperature and time period at which desired electrophotographic characteristics can be obtained. In the wet method, moisture contained in the inorganic particles may be removed prior to adding the surface treatment agent. The moisture can be removed by, for example, stirring and heating the particles in a solvent used for the surface treatment, or by performing azeotropic removal with the solvent.

The inorganic particles may be subjected to a surface treatment prior to the addition of the acceptor compound. The surface treatment agent may be any agent with which desired characteristics may be obtained, and may be selected from known materials. Examples thereof include silane coupling agents, titanate-based coupling agents, aluminum-based coupling agents and surfactants. Among these, silane coupling agents are preferably used, in view of providing favorable electrophotographic characteristics. Moreover, a silane coupling agent having an amino group is preferably used in view of imparting favorable blocking properties to the undercoating layer 1.

The silane coupling agents having an amino group may be any compounds with which desired electrophotographic photoreceptor characteristics can be obtained. Specific examples thereof include γ-aminopropyltriethoxysilane, N-β-(aminoethyl)-γ-aminopropyltrimethoxysilane, N-β-(aminoethyl)-γ-aminopropylmethydilmethoxysilane, and N,N-bis(β-hydroxyethyl)-γ-aminopropyltriethoxysilane, but the invention is not limited thereto.

The silane coupling agent may be used singly or in combination of two or more kinds thereof. Examples of the silane coupling agent that may be used in combination with the above-described silane coupling agent having an amino group include vinyltrimethoxysilane, γ-methacryloxypropyl-tris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but the invention is not limited thereto.

The surface treatment may be conducted by any known dry or wet method. Further, addition of an acceptor compound and a surface treatment using a coupling agent or the like may be carried out simultaneously.

The content of the silane coupling agent with respect to the inorganic particles contained in the undercoating layer 1 can be determined as appropriate as long as desired electrophotographic characteristics can be obtained, but preferably 0.5% by weight to 10% by weight from the viewpoint of improving dispersibility.

As the binder resin contained in the undercoating layer 1, any known resins with which a favorable film can be formed and desired characteristics can be achieved may be used. Examples thereof include known polymer resin compounds, for example, acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having a charge transporting group; and conductive resins such as polyaniline. Among these, resins which are insoluble in a coating solvent for an upper layer are particularly preferably used, and examples thereof include phenolic resins, phenol-formaldehyde resins, melamine resins, urethane resins, epoxy resins and the like. When these resins are used in combination of two or more kinds, the mixing ratio can be appropriately determined according to the circumstances.

The ratio of the metal oxide to which an acceptor property has been imparted with respect to the binder resin, or the ratio of the inorganic particles with respect to the binder resin, in the coating solution for forming the undercoating layer, can be appropriately determined as long as desired electrophotographic photoreceptor characteristics can be obtained.

Various additives may be used for the undercoating layer 1 to improve electrical characteristics, environmental stability or image quality. Examples of the additives include known materials such as polycyclic condensed type or azo-based type electron transporting pigments, zirconium chelate compounds, titanium chelate compounds, aluminum chelate compounds, titanium alkoxide compounds, organic titanium compounds, and silane coupling agents. Silane coupling agents, which are used for surface treatment of a metal oxide, may also be added to the coating solution as additives. Specific examples of the silane coupling agents include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminato, and polyhydroxy titanium stearate.

Examples of the aluminum chelate compounds include aluminum isopropylate, monobutoxy aluminum diisopropylate, aluminum butylate, ethylacetoacetate aluminum diisopropylate, and aluminum tris(ethylacetoacetate).

These compounds may be used alone, or as a mixture or a polycondensate of two or more kinds thereof.

The solvent for preparing the coating solution for forming the undercoating layer may appropriately be selected from known organic solvents such as alcohol-based, aromatic, hydrocarbon halide-based, ketone-based, ketone alcohol-based, ether-based, and ester-based solvents. Examples thereof include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

The solvent used for dispersing the above compounds may be used alone or as a mixture of two or more kinds. When they are mixed, any mixed solvents which can solve a binder resin can be used.

The dispersion may be conducted using known devices such as a roll mill, a ball mill, a vibration ball mill, an attritor, a sand mill, a colloid mill, or a paint shaker. The application of the undercoating layer 1 may be conducted by known methods such as blade coating, wire bar coating, spray coating, dip coating, bead coating, air knife coating, or curtain coating.

The undercoating layer 1 is formed on the conductive substrate 4 using a coating solution obtained by the above-described method.

The Vickers hardness of the undercoating layer 1 is preferably 35 or more. The thickness of the undercoating layer 1 can be optionally determined as long as desired characteristics can be obtained, but preferably 15 μm or more, and more preferably 15 μm or more and 50 μm or less.

When the thickness of the undercoating layer 1 is less than 15 μm, sufficient anti-leakage properties may not be obtained, while when the thickness of the undercoating layer 1 exceeds 50 μm, residual potential tends to remain in a long-term operation to cause defects in image concentration.

The surface roughness of the undercoating layer 1 (ten point height of irregularities) is adjusted to be in a range of from ¼n to ½λ (λ represents the wavelength of the laser used for exposure, and n represents a refractive index of the upper layer), in order to prevent formation of a moire image. Particles of a resin or the like may also be added to the undercoating layer for adjusting the surface roughness. Examples of the resin particles include silicone resin particles and crosslinked polymethyl methacrylate resin particles.

The undercoating layer 1 contains a binder resin and a conductive metal oxide, and preferably has a light transmission with respect to light with a wavelength of 950 nm at a thickness of 20 μm of 40% or less, or about 40% or less (more preferably from 10% to 30% and still more preferably 15% to 35%). In order to achieve a longer operating life of an electrophotographic photoreceptor, it is necessary to maintain image quality at high level in a stable manner. Similar characteristics are also required when a crosslinked outermost layer (protective layer) is used. In a crosslinked outermost layer (protective layer), an acid catalyst is often used, and the larger the amount of the acid catalyst in the solid content of the outermost layer (protective layer) is, the more the film strength is increased and the printing durability is improved, thereby realizing a longer operating life. On the other hand, the acid catalyst remaining in a bulk may serve as a trap site at which charges are trapped, which may become a factor of lowering the resistance to light-induced fatigue and causing unevenness in image density due to exposure to light at the time of maintenance or the like. The lightfastness (resistance to light-induced fatigue) can be improved to an acceptable level in practical use by optimizing the amount of the material (in particular, a charge transporting material and an acid catalyst). However, such an improvement may not be enough against irradiation in an environment with illumination brighter than a normal office, such as a showroom, or exposure with light at high brightness for a long period of time, for example, such as illumination used when inspecting the surface of the electrophotographic photoreceptor for foreign matters. In such cases, sufficient level of lightfastness may not be achieved, in spite of the need to increase the amount of the curing catalyst to enhance the film strength.

However, when an undercoating layer having a light transmission within the above range (i.e., having a low light transmission) is used, incident light to the electrophotographic photoreceptor can be absorbed by the undercoating layer, thereby achieving superior fastness to light with high intensity, and thus images can be formed over a long period of time, in a stable manner. More specifically, reduced amount of light reflected from the surface of the conductive substrate serves to provide lightfastness (resistance to light-induced fatigue) against a long-term exposure to light with high intensity. Accordingly, a longer operating life can be realized even when the amount of the curing catalyst is increased in order to enhance the strength of the outermost layer (protection layer) and improve the printing durability.

The light transmission of the undercoating layer can be measured in accordance with the following method. A coating solution for forming an undercoating layer is applied onto a glass plate to a dried thickness of 20 μm. After drying, light transmission to light at a wavelength of 950 nm is measured using a spectrophotometer (U-2000, trade name, manufactured by HITACHI, Ltd.).

The light transmission of the undercoating layer can be controlled by adjusting the time for carrying out dispersion using the above-mentioned roll mill, ball mill, vibration ball mill, attritor, sand mill, colloid mill, paint shaker or the like. The time for dispersion is not particularly limited, but is preferably from 5 minutes to 1,000 hours, more preferably from 30 minutes to 10 hours. As the time for dispersion is extended, the light transmission tends to decrease.

Further, the undercoating layer may be polished in order to adjust the surface roughness-thereof. Methods of polishing include buff polishing, sand blast treatment, wet honing, grinding treatment or the like.

The undercoating layer is obtained by drying the applied material. Drying is generally carried out by allowing a solvent to evaporate at a temperature at which a film can be formed.

<Charge Generating Layer>

The charge generating layer 2 is a layer including a charge generating material and a binder resin.

The charge generating materials include azo pigments such as bis-azo pigments and tris-azo pigments, condensed aromatic pigments such as dibromoanthanthrone, perylene pigments, pyrrolopyrrole pigments, phthalocyanine pigments, zinc oxide, and trigonal selenium. Among these, metal- or non metal-phthalocyanine pigments are favorably used in exposure with near-infrared laser light. In particular, hydroxygallium phthalocyanine disclosed in JP-A Nos. 5-263007 and 5-279591, chlorogallium phthalocyanine disclosed in JP-A No. 5-98181, dichlorotin phthalocyanine disclosed in JP-A Nos. 5-140472 and 5-140473, and titanylphthalocyanine disclosed in JP-A No. 4-189873. In exposure with near-ultraviolet laser light, condensed aromatic pigments such as dibromoanthanthrone, thioindigo pigments, porphyrazine compounds, zinc oxide, trigonal selenium or the like are favorably used.

The charge generating material is preferably an inorganic pigment when a light source with a wavelength of 380 nm to 500 nm is used, and a non-metal phthalcyanine pigment is preferable when a light source with a wavelength of 700 nm to 800 nm is used.

Hydroxygallium phthalozyanine pigments having a maximum peak wavelength in a range of from 810 nm to 839 nm in a spectral absorption spectrum of a wavelength region of from 600 nm to 900 nm are preferably used as the charge generating material. Hydroxygallium phthalocyanine pigments having the above feature differ from conventional V-type hydroxygallium phthalocyanine pigments, and exhibit a higher level of dispersibility. By shifting the maximum peak wavelength of a spectral absorption spectrum so as to be shorter than that of conventional V-type hydroxygallium phthalocyanine pigments, fine hydroxygallium phthalocyanine pigments having a structure in which crystal arrangement of pigment particles is favorably regulated can be obtained, and when such pigments are used as a material for an electrophotographic photoreceptor, superior dispersibility as well as sufficient sensitivity, chargeability and dark decay characteristics may be obtained.

The hydroxygallium phthalozyanine pigment having a maximum peak wavelength in a range of from 810 nm to 839 nm preferably has an average particle size and a BET specific surface area in a certain range. Specifically, the average particle diameter is preferably 0.20 μm or less, and more preferably from 0.01 μm to 0.15 μm. The BET specific surface area is preferably 45 $m^2/g$ or more, and more preferably 50 $m^2/g$ or more, and particularly preferably from 55 $m^2/g$ to 120 $m^2/g$. The average particle size here is a volume average particle size (d50 average particle size) measured by a laser diffraction/scattering type particle size distribution tester (LA-700, trade name, manufactured by Horiba, Ltd.), and the BET specific surface area is measured by a nitrogen substitution method using a BET specific surface area analyzer (FLOWSORB II 2300, trade name, manufactured by Shimadzu Corporation).

When the average particle diameter is greater than 0.20 μm or the BET specific surface area is less than 45 $m^2/g$, it is considered that the pigment particles are coarse or forming an aggregation. In such a case, defects in dispersibility, sensitivity, chargeability and dark decay characteristics are prone to occur, increasing the chances of forming image defects.

The maximum particle size (maximum primary particle size) of the hydroxygallium phthalozyanine pigment is preferably 1.2 μm or less, more preferably 1.0 μm or less, and particularly preferably 0.3 μm or less. When the maximum particle size is over the above range, minute black spots tend to be formed.

Further, from the viewpoint of more securely suppressing the density unevenness in the electrophotographic photoreceptor caused upon exposure to a fluorescent lamp or the like, the hydroxygallium phthalocyanine pigment preferably has an average particle size of 0.2 μm or less, a maximum particle size of 1.2 μm or less, and a BET specific surface area of 45 $m^2/g$ or more.

Moreover, the hydroxygallium phthalocyanine pigment preferably has diffraction peaks at 7.5°, 9.9°, 12.5°, 16.3°, 18.6°, 25.1° and 28.3° of Bragg angles (2±0.2°) in an X-ray diffraction spectrum obtained using CuKα characteristic X rays.

The hydroxygallium phthalocyanine pigment preferably has a thermogravimetric reduction rate when a temperature is increased from 25° C. to 400° C. of from 2.0% to 4.0%, and more preferably from 2.5% to 3.8%. The thermogravimetric reduction rate is measured by a thermobalance or the like. When the thermogravimetric reduction rate exceeds 4.0%, impurities contained in the hydroxygallium phthalocyanine pigment may affect the electrophotographic photoreceptor, causing damages in sensitivity characteristics, stability of potential upon repeated use, or image quality. On the other hand, when the thermogravimetric reduction rate is less than 2.0%, reduction in sensitivity may occur. This is thought to be that the hydroxygallium phthalocyanine pigment exerts a sensitization action by interacting with molecules of a solvent that are present in a crystal of the pigment in a small amount.

The hydroxygallium phthalocyanine pigment satisfying the above feature, having an ability of imparting optimal sensitivity and superior photoelectric characteristics to the electrophotographic photoreceptor and having superior dispersibility in a binder resin contained in the photosensitive layer, is particularly preferably used as a charge generating material from the viewpoint of improving image quality characteristics.

It has been known that by specifying the average particle size and BET specific surface area of the hydroxygallium phthalocyanine pigment, occurrence of fogging at an initial stage or black spots can be suppressed. On the other hand, there has been a problem in that fogging or black spots occur when the electrophotographic photoreceptor is used over the long term. However, by employing an outermost layer to be described later (a protective layer including a cross-linked film formed from at least one selected from a guanamine compound or a melamine compound, and a specific charge transport material), occurrence of fogging or black spots due to long-term use, which are caused when conventional outermost layer or charge generating layer are used, may be suppressed. This is thought to be that the attrition of a film or reduction in chargeability due to long-term use is suppressed by the above-mentioned protective layer. Further, even when the thickness of a charge transport layer is reduced in order to improve electric characteristics (reduce the residual potential), fogging or black spots, which would occur in a conventional electrophotographic photoreceptor, may be suppressed.

The binder resin used in the charge generating layer 2 can be selected from a wide range of insulating resins, and also from organic photoconductive polymers such as poly-N-vinyl carbazole, polyvinyl anthracene, polyvinyl pyrene, and polysilane. Preferable examples of the binder resin include polyvinyl butyral resins, polyarylate resins (polycondensates of bisphenols and aromatic divalent carboxylic acid, or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binder resins may be used alone or in combination of two or more kinds. The mixing ratio between the charge generating material and the binder resin is preferably in the range of from 10:1 to 1:10 by weight ratio.

The term "insulating" here means that the resin has a volume resistivity of $10^{13}$ Ωcm or more.

The charge generating layer 2 may be formed using a coating solution in which a charge generating material and a binder resin as described above are dispersed in a given solvent.

Examples of the solvent used for the dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used alone or in combination of two or more kinds.

The method of dispersing a charge generating material and a binder resin in a solvent may be any ordinary method such as ball mill dispersion, attritor dispersion and sand mill dispersion. By employing these dispersion methods, deformation of crystals of the charge generating material caused by a dispersion process can be prevented. The average particle diameter of the charge generating material to be dispersed is preferably 0.5 μm or less, more preferably 0.3 μm or less, and further preferably 0.15 μm or less.

The method of forming the charge generating layer 2 may be any conventional methods such as blade coating, Meyer bar coating, spray coating, dip coating, bead coating, air knife coating, or curtain coating.

The film thickness of the charge generating layer 2 obtained by the above-described method is preferably 0.1 μm to 5.0 μm, and more preferably 0.2 μm to 2.0 μm.

<Charge Transport Layer>

The charge transport layer 3 includes a charge transporting material and a binder resin, or includes a polymeric charge transporting material.

Examples of the charge transporting material include electron transporting compounds, e.g., quinone-based compounds such as p-benzoquinone, chloranil, bromanil and anthraquinone, tetracyanoquinodimethane-based compounds, fluorenone compounds such as 2,4,7-trinitro fluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds. These charge transporting materials may be used alone or in combination of two or more kinds thereof but are not limited thereto.

The charge transporting material is preferably a triaryl amine derivative represented by the following formula (a-1) and a benzidine derivative represented by the following formula (a-2), from the viewpoint of charge mobility.

(a-1)

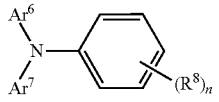

In formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)=C(R^{10})(R^{11})$, or $—C_6H_4—CH=CH—CH=C(R^{12})(R^{13})$, wherein $R_9$ through $R_{13}$ each independently represent a hydrogen atom, a substituted or unsubstituted alkyl group, or a substituted or unsubstituted aryl group. The substituent is a halogen atom, an alkyl group having 1 to 5 carbon atoms, an alkoxy group having 1 to 5 carbon atoms, or an amino group substituted by an alkyl group having 1 to 3 carbon atoms.

(a-2)

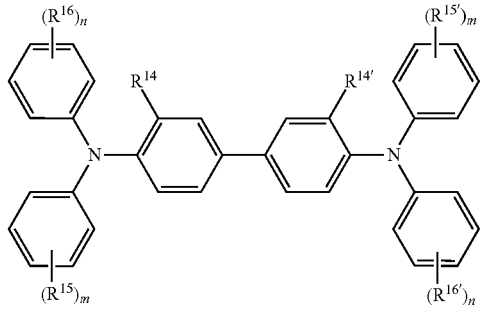

In formula (a-2), $R^{14}$ and $R^{14'}$ may be the same or different from each other, and each independently represent a hydrogen atom, a halogen atom, an alkyl group having 1 to 5 carbon atoms, or an alkoxy group having 1 to 5 carbon atoms; $R^{15}$, $R^{15'}$, $R^{16}$ and $R^{16'}$ may be the same or different from each other, and each independently represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, a substituted or unsubstituted aryl group, $—C(R^{17})=C(R^{18})(R^{19})$, or $—CH=CH—CH=C(R^{20})(R^{21})$, wherein $R^{17}$ through $R^{21}$ each independently represent a hydrogen atom, a substituted or unsubstituted alkyl group, or a substituted or unsubstituted aryl group, and m and n each independently represent an integer of from 0 to 2.

Among the triarylamine derivatives represented by formula (a-1) and the benzidine derivatives represented by formula (a-2), triarylamine derivatives having $—C_6H_4—CH=CH—CH=C(R^{12})(R^{13})$ and benzidine derivatives having $—CH=CH—CH=C(R^{20})(R^{21})$ are particularly preferable in view of providing excellent charge mobility, adhesiveness to the protective layer, and an ability of preventing a ghost (a residual image formed by the record of an image previously formed).

Examples of the binder resin used in the charge transport layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole, and polysilane. Further, as described above, polymeric charge transporting materials may also be used as the binder resin, such as the polyester-based polymer charge transporting materials disclosed in JP-A Nos. 8-176293 and 8-208820. These binder resins may be used alone or in combination of two or more kinds. The mixing ratio between the charge transporting material and the binder resin is preferably from 10:1 to 1:5 by weight ratio.

The binder resin is not particularly limited, but preferably include at least one selected from a polycarbonate resin having a viscosity-average molecular weight of from 50,000 to 80,000 or a polyarylate resin having a viscosity-average molecular weight of from 50,000 to 80,000, from the viewpoint of forming a favorable film.

Polymeric charge transport material may also be used as the charge transporting material. As the polymeric charge transporting material, known materials having charge transporting properties such as poly-N-vinyl carbazole and polysilane may be used. Polyester-based polymeric charge transporting materials disclosed in JP-A Nos. 8-176293 and 8-208820, having higher charge transporting properties than that of other species, are particularly preferred. Charge transporting polymer materials can form a film independently, but may also be mixed with the above-described binder resin to form a film.

The charge transport layer 3 may be formed using the coating solution containing the above-described materials. Examples of the solvent used for the coating solution for forming the charge transport layer include ordinary organic solvents, e.g., aromatic hydrocarbons such as benzene, toluene, xylene and chlorobenzene; ketones such as acetone and 2-butanone; aliphatic hydrocarbon halides such as methylene chloride, chloroform and ethylene chloride; and cyclic or straight-chained ethers such as tetrahydrofuran and ethyl ether. These solvents may be used alone or in combination of two or more kinds. As the method for dispersing the above-described materials, known methods may be used.

As the method for applying the coating solution for forming the charge transport layer onto the charge generating layer 2, ordinary methods such as blade coating, Meyer bar coating, spray coating, dip coating, bead coating, air knife coating and curtain coating may be used.

The film thickness of the charge transport layer 3 is preferably from 5 μm to 50 μm, and more preferably from 10 μm to 30 μm.

<Protective Layer>

The protective layer 5, which is an outermost layer of the electrophotographic photoreceptor 7, is formed for the purpose of imparting surface resistance against abrasion or scratches, and enhancing the toner transferring efficiency.

The protective layer 5 is formed from a coating solution containing a crosslinked product including at lease one selected from a guanamine compound or a melamine compound, and at least one charge transporting material having at least one substituent selected from the group consisting of —OH, —$OCH_3$, —$NH_2$, —SH and —COOH.

The guanamine compound is a compound having a guanamine skeleton (structure), and examples thereof include acetoguanamine, benzoguanamine, formguanamine, steroguanamine, spiroguanamine, and cyclohexylguanamine.

<Guanamine Compound>

The guanamine compound is particularly preferably at least one of the compound represented by the following formula (A) or a multimer thereof. The multimer here refers to an oligomer having a polymerization degree of, for example, from 2 to 200, preferably from 2 to 100, which is obtained by polymerizing the compound represented by formula (A) as a structural unit. The compound represented by formula (A) may be used alone or as a mixture of two or more kinds thereof. In particular, solubility to a solvent of the compound represented by formula (A) may be improved by using the compound of two or more kinds in combination, or by using the compound in the form of a multimer (oligomer) including the compound as a structural unit.

(A)

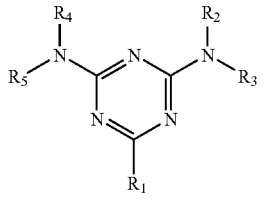

In formula (A), $R_1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms, and $R_2$ through $R_5$ each independently represent a hydrogen atom, —$CH_2$—OH or —$CH_2$—O—$R_6$ wherein 16 represents a linear or branched alkyl group having 1 to 10 carbon atoms.

In formula (A), the alkyl group represented by $R_1$ has carbon atoms of 1 to 10, preferably 1 to 8, and more preferably 1 to 5. The alkyl group may be either linear or branched.

In formula (A), the phenyl group represented by $R_1$ has carbon atoms of 6 to 10, preferably 6 to 8. Examples of the substituent that may substitute the phenyl group include a methyl group, an ethyl group, and a propyl group.

In formula (A), the alicyclic hydrocarbon group represented by $R_1$ has carbon atoms of 4 to 10, preferably 5 to 8. Examples of the substituent that may substitute the alicyclic hydrocarbon group include a methyl group, an ethyl group, and a propyl group.

In formula (A), the alkyl group represented by $R_6$ in "—$CH_2$—O—$R_6$" represented by $R_2$ through $R_5$ has carbon atoms of 1 to 8, preferably 1 to 8, and more preferably 1 to 6. The alkyl group may be either linear or branched. Preferable examples of the alkyl group include a methyl group, an ethyl group, and a butyl group.

The compound represented by formula (A) is particularly preferably a compound in which $R_1$ represents a substituted or unsubstituted phenyl group having 6 to 10 carbon atoms, and $R_2$ through $R_5$ each independently represent —$CH_2$—O—$R_6$. $R_6$ is preferably selected from a methyl group or an n-butyl group.

The compound represented by formula (A) may be synthesized from, for example, guanamine and formaldehyde by a known method described on page 430 of Jikken Kagaku Koza, Fourth edition, Vol. 28.

The following are specific examples of the compound represented by formula (A), but the invention is not limited to these examples. The following specific examples are described in the form of a monomer, but the compound may be in the form of a multimer (oligomer) having the monomer as a structural unit.

(A)-1

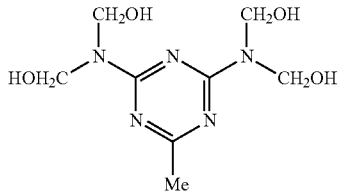

-continued
(A)-2
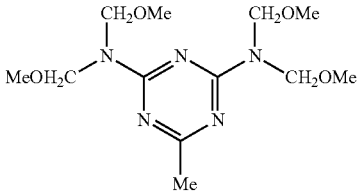
(A)-3
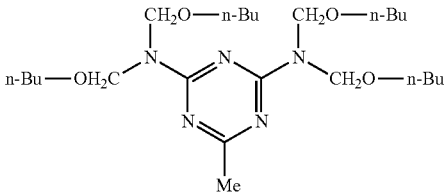
(A)-4
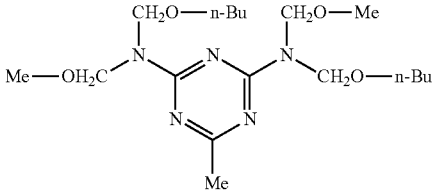
(A)-5
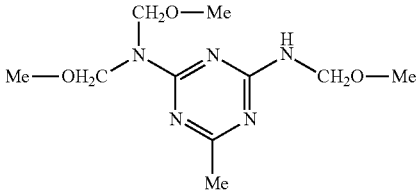
(A)-6
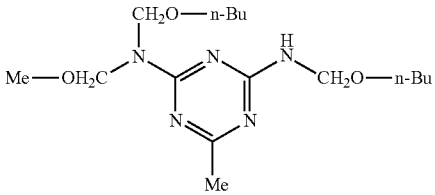
(A)-7
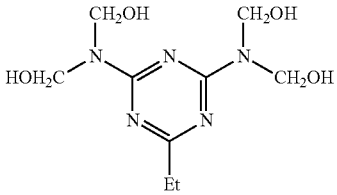
(A)-8
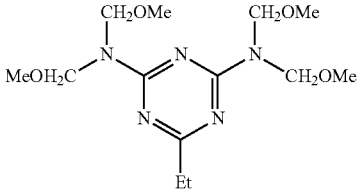
(A)-9
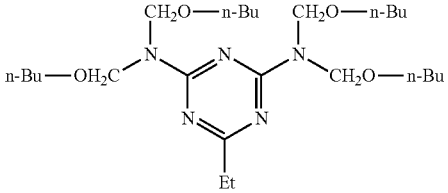
-continued
(A)-10
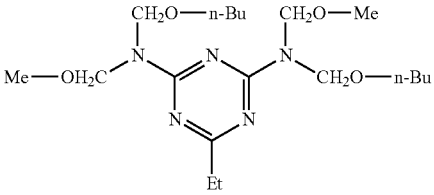
(A)-11
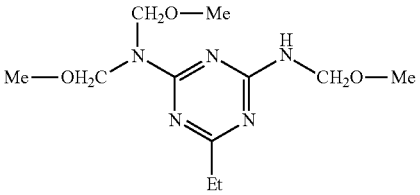
(A)-12
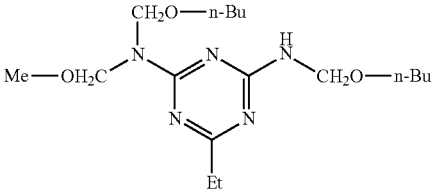
(A)-13
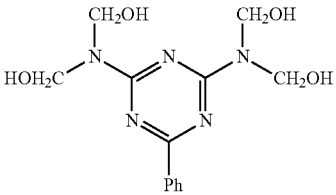
(A)-14
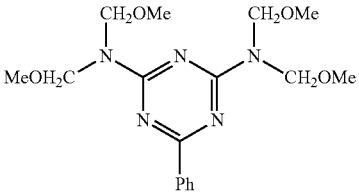
(A)-15
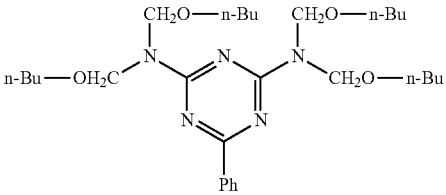
(A)-16
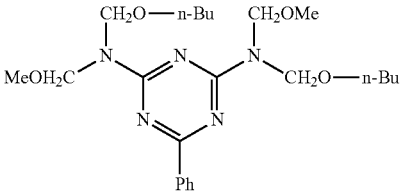
(A)-17
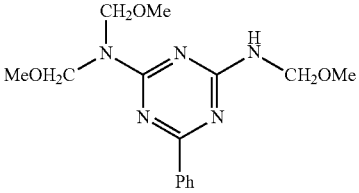

-continued
(A)-18
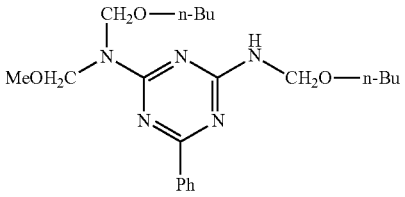
(A)-19
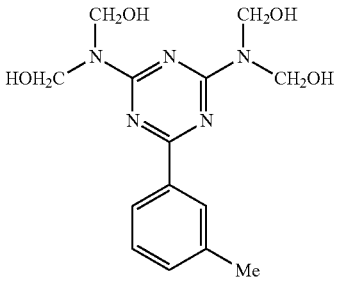
(A)-20
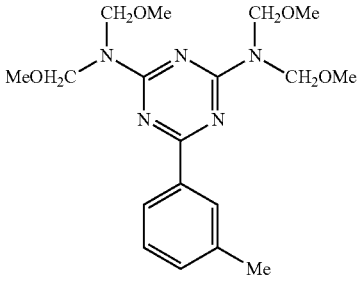
(A)-21
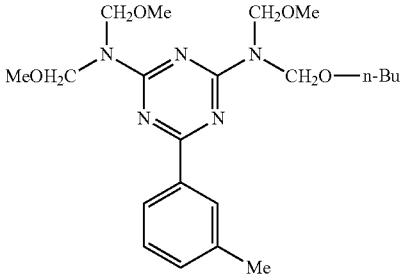
(A)-22
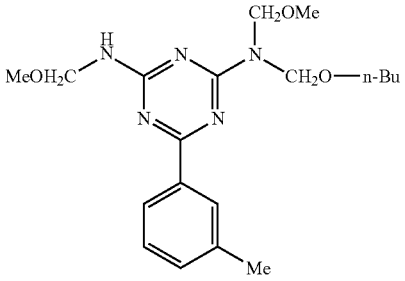
(A)-23
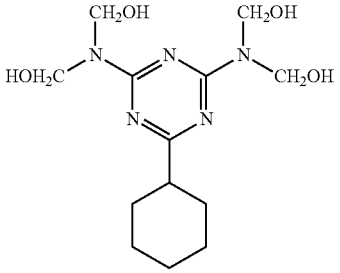
-continued
(A)-24
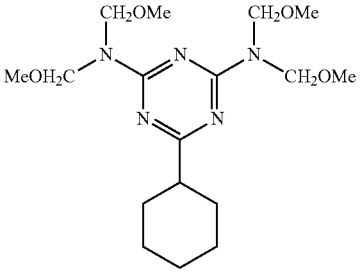
(A)-25
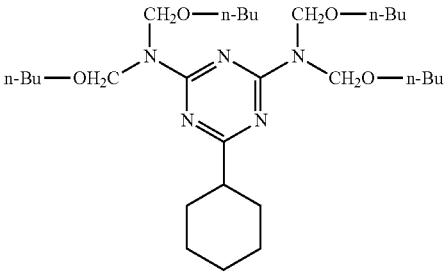
(A)-26
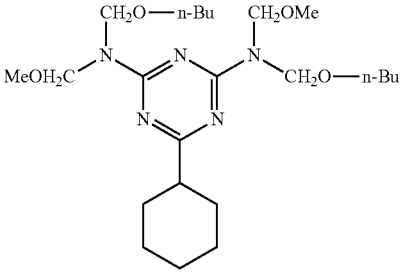
(A)-27
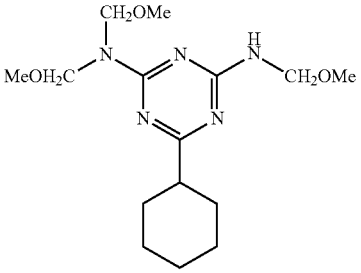
(A)-28
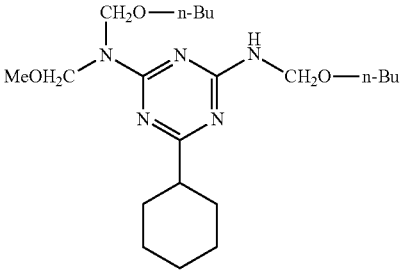

-continued
(A)-29
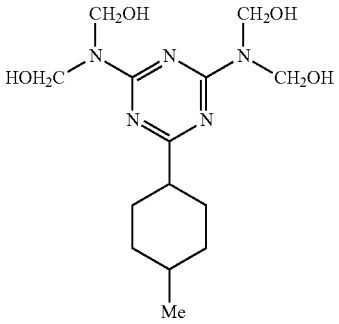
(A)-30
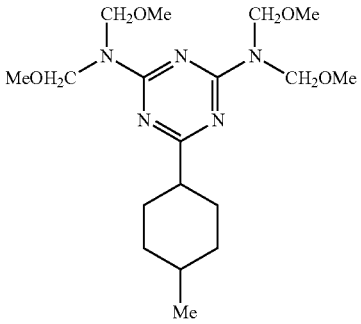
(A)-31
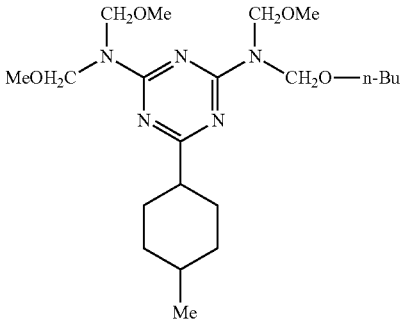
(A)-32
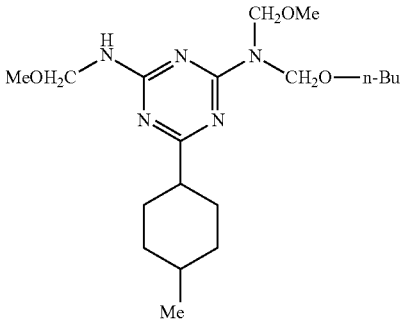
(A)-33
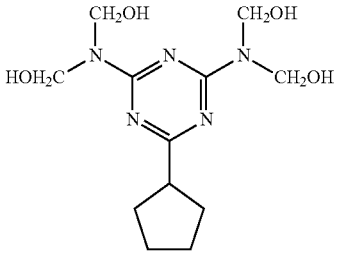
-continued
(A)-34
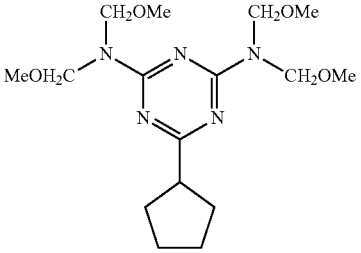
(A)-35
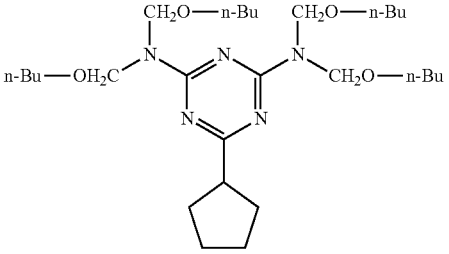
(A)-36
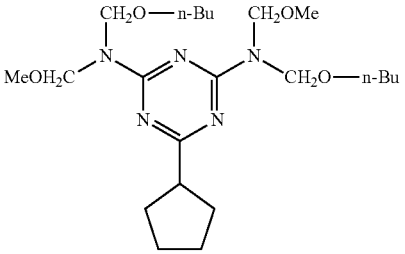
(A)-37
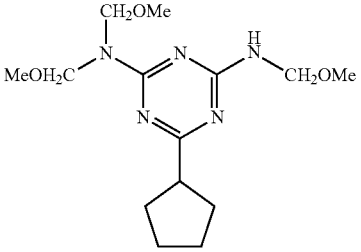
(A)-38
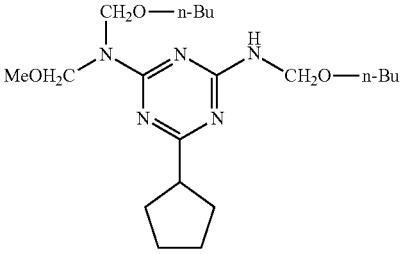
(A)-39
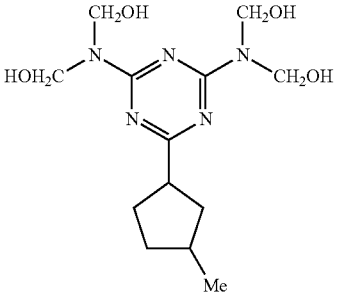

-continued (A)-40

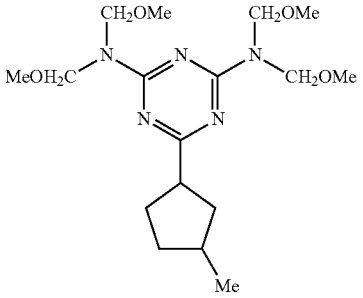

(A)-41

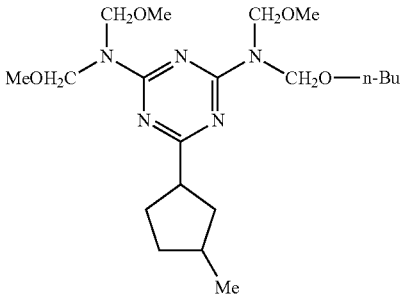

(A)-42

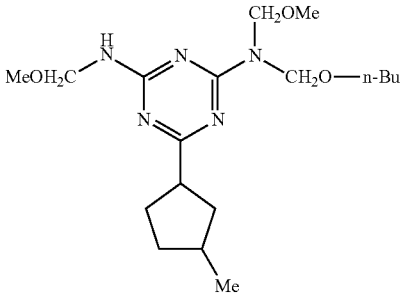

Examples of commercial products of the compound represented by formula (A) include SUPER BECKAMIN (R) L-148-55, SUPER BECKAMIN (R) 13-535, SUPER BECKAMIN (R) L-145-60 and SUPER BECKAMIN (R) TD-126 (trade name, manufactured by DIC Inc.), and NIKALACK BL-60 and NIKALACK BX-4000 (trade name, manufactured by Nippon Carbide Industries Co., Inc.).

In order to remove the influence of the residual catalyst, the compound represented by formula (A) (including a multimer thereof) obtained by synthesizing or purchasing may then be dissolved in an appropriate solvent such as toluene, xylene or ethyl acetate, and washed with distilled water or ion exchanged water, or may be treated with an ion exchange resin.

<Melamine Compound>

The melamine compound is particularly preferably at least one of the compound represented by the following formula (B) and a multimer thereof. As with the above-described guanamine compound, the multimer here refers to an oligomer having a polymerization degree of, for example, from 2 to 200, preferably from 2 to 100, obtained by polymerizing the compound represented by formula (B) as a structural unit. The compound represented by formula (B) may be used alone or as a mixture of two or more kinds thereof or may be used in combination with the compound represented by formula (A) or a multimer thereof. In particular, solubility to a solvent of the compound represented by formula (B) can be improved by using the compound of two or more kinds in combination, or by using the compound in the form of a multimer (oligomer) including the compound as a structural unit.

(B)

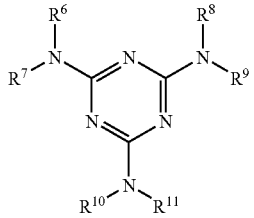

In formula (B), $R^6$ through $R^{11}$ each independently represent a hydrogen atom, —$CH_2$—OH or —$CH_2$—O—$R^{12}$ wherein $R^{12}$ represents a linear or branched alkyl group having 1 to 5 carbon atoms. Examples of the alkyl group include a methyl group, an ethyl group and a butyl group.

The compound represented by formula (B) may be synthesized from, for example, melamine and formaldehyde by a known method described on page 430 of Jikken Kagaku Koza, Fourth edition, Vol. 28.

The following are specific examples of the compound represented by formula (B), but the invention is not limited to these examples. The following specific examples are described in the form of a monomer, but the compound may be in the form of a multimer (oligomer) having the monomer as a structural unit.

(B)-1

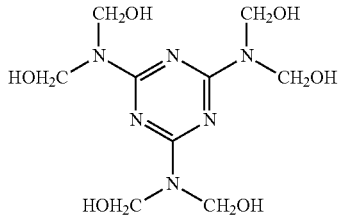

(B)-2

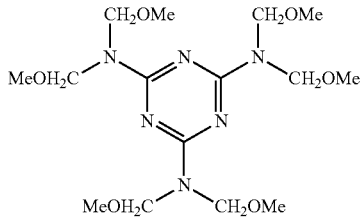

(B)-3

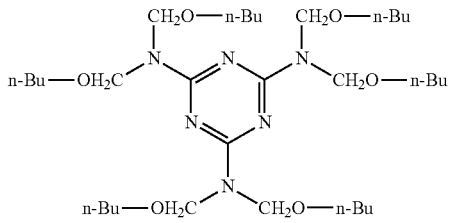

-continued (B)-4

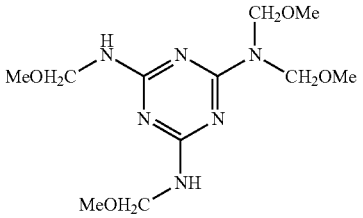

(B)-5

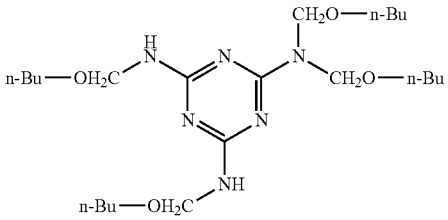

(B)-6

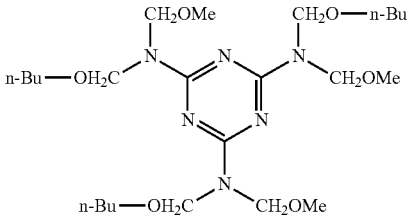

(B)-7

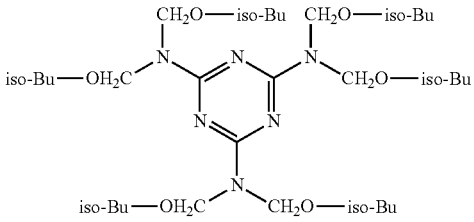

Examples of commercial products of the compound represented by formula (B) include SUPER MELAMI No. 90 (trade name, manufactured by NOF Corporation), SUPER BECKAMIN (R) TD-139-60 (trade name, manufactured by DIC Inc.), UBAN 2020 (trade name, manufactured by Mitsui Chemicals, Inc.), SUMITEX RESIN M-3 (trade name, manufactured by Sumitomo Chemical Co., Ltd.) and NIKALACK MW-30 (trade name, manufactured by Nippon Carbide Industries Co., Inc.).

In order to remove the influence of the residual catalyst, the compound represented by formula (B) (including a multimer thereof) obtained by synthesizing or purchasing may then be dissolved in an appropriate solvent such as toluene, xylene or ethyl acetate, and washed with distilled water or ion exchanged water, or may be treated with an ion exchange resin.

<Charge Transport Material>

The specific charge transporting material used in the invention has at least one substituent selected from the group consisting of —OH, —$OCH_3$, —$NH_2$, —SH, and —COOH. The specific charge transporting material particularly preferably has at least two (or even more preferably three) substituents selected from the group consisting of —OH, —$OCH_3$, —$NH_2$, —SH, and —COOH. As the number of the reactive functional group (substituent) of the specific charge transporting material increases, the crosslink density is increased to form a crosslinked film having an enhanced strength. In particular, in cases in which a blade cleaner is used, the running torque of the electrophotographic photoreceptor may be reduced, thereby suppressing damages to the blade or wear of the electrophotographic photoreceptor. The reason for this effect is not clear, but it is thought to be that the increased crosslink density of the cured film due to the increased number of the reactive functional groups suppresses the molecular motion at the outermost surface of the electrophotographic photoreceptor and reduces interaction with the molecules on the surface of the blade member.

The specific charge transporting material is preferably the compound represented by the following formula (I):

$$F—((—R_1—X)_{n1}R_2—Y)_{n2} \quad (I)$$

In formula (I), F represents an organic group derived from a compound having a hole transporting ability; $R_1$ and $R_2$ each independently represent a linear or branched alkylene group having 1 to 5 carbon atoms; n1 represents 0 or 1; n2 represents an integer of 1 to 4; X represents an oxygen atom, NH, or a sulfur atom; and Y represents —OH, —$OCH_3$, —$NH_2$, —SH, or —COOH.

In formula (I), the compound having a hole transporting ability from which the organic group represented by F is derived is preferably an arylamine derivative. Preferable examples of the arylamine derivative include triphenylamine derivatives and tetraphenylbenzidine derivatives.

The compound represented by formula (I) is preferably the compound represented by the following formula (II). The compound represented by formula (II) exhibits excellent charge mobility or stability against oxidation, in particular.

(II)

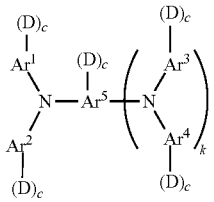

In formula (II), $Ar^1$ through $Ar^4$ may be the same or different from each other and each independently represent a substituted or unsubstituted aryl group; $Ar^5$ represents a substituted or unsubstituted aryl group or a substituted or unsubstituted arylene group; D represents —(—$R_1$—X)$_{n1}$$R_2$—Y; c represents 0 or 1; k represents 0 or 1; the total number of D is 1 to 4; $R_1$ and $R_2$ each independently represent a linear or branched alkylene group having 1 to 5 carbon atoms; n1 represents 0 or 1; X represents an oxygen atom, NH, or a sulfur atom; and Y represents —OH, —$OCH_3$, —$NH_2$, —SH, or —COOH.

In formula (II), "—(—$R_1$—X)$_{n1}$$R_2$—Y" represented by D is defined in the same manner as in formula (I), $R_1$ and $R_2$ each independently represent a linear or branched alkylene group having 1 to 5 carbon atoms, n1 is preferably 1, X is preferably an oxygen atom, and Y is preferably a hydroxyl group. The total number of D in formula (II) corresponds to n2 in formula (I), which is preferably from 2 to 4 and more preferably from 3 to 4. Namely, when the total number of D in formulae (I) and (II) is from 2 to 4 and more preferably from 3 to 4 per molecule, the crosslink density of the obtained crosslinked film may be increased and thus a stronger crosslinked film may be formed. In particular, the running torque of the electrophotographic photoreceptor when a blade cleaner is used may be reduced, thereby suppressing damages to the blade or wear of the electrophotographic photoreceptor. The reason for this is not clear, but it is thought that the increased number of the reactive functional groups increases the crosslinking density of the cured film, and suppresses molecular motion at the outermost surface of the electrophotographic photoreceptor and reduces interaction with the molecules on the surface of the blade member.

In formula (II), $Ar_1$ through $Ar_4$ are preferably represented by any one selected from the formulae (1) through (7). In the following, the formulae (1) through (7) are shown with "-$(D)_c$" which may be linked to each of $Ar_1$ through $Ar_4$.

(1)

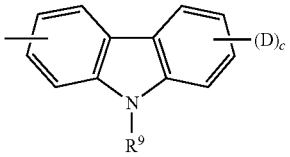

(2)

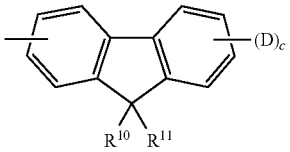

(3)

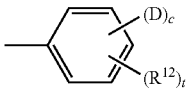

(4)

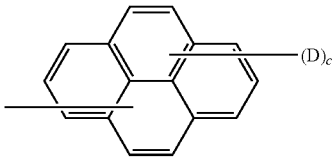

(5)

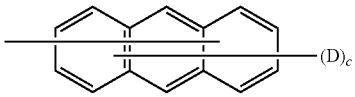

(6)

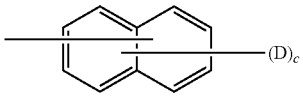

(7)

In formulae (1) and (7), $R^9$ represents a hydrogen atom, an alkyl group having 1 to 4 carbon atoms, a phenyl group substituted by an alkyl group having 1 to 4 carbon atoms or an alkoxy group having 1 to 4 carbon atoms, an unsubstituted phenyl group, or an aralkyl group having 7 to 10 carbon atoms; $R^{10}$ through $R^{12}$ each independently represent a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, or a halogen atom; Ar represents a substituted or unsubstituted arylene group; D and c are defined in the same manner as "D" and "c" in formula (II); s represents 0 or 1; and t represents an integer of from 1 to 3.

In formula (7), Ar preferably represents the following formula (8) or (9).

(8)

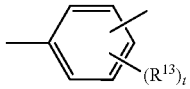

(9)

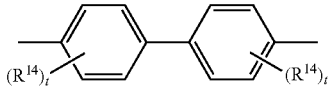

In formulae (8) and (9), $R^{13}$ and $R^{14}$ each independently represent a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, or a halogen atom; and t represents an integer of from 1 to 3.

In formula (7), Z' preferably represents one selected from the following formulae (10) through (17).

(10)

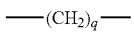

(11)

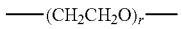

(12)

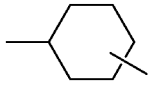

(13)

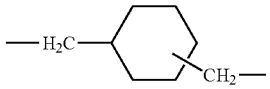

(14)

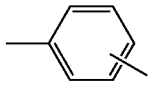

(15)

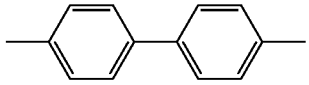

(16)

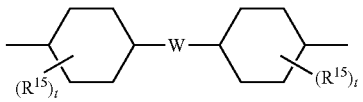

(17)

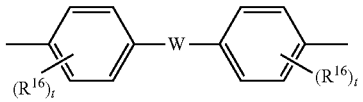

In formulae (10) through (17), $R^{15}$ and $R^{16}$ each independently represent a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, or a halogen atom; W represents a divalent group; q and r each independently represent an integer of from 1 to 10; and t represents an integer of from 1 to 3.

In formulae (16) and (17), W is preferably a divalent group represented by any one of the formulae (18) through (26). In formula (25), u represents an integer of from 0 to 3.

(18) —$CH_2$—

(19) —$C(CH_3)_2$—

(20) —O—

(21) —S—

(22) —$C(CF_3)_2$—

(23) —$Si(CH_3)_2$—

(24)

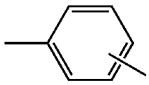

(25)

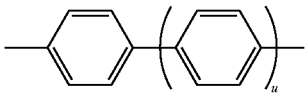

(26)

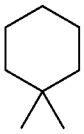

In formula (II), when k is 0, $Ar^5$ is an aryl group represented by the aforementioned formulae (1) through (7) shown in the explanation of $Ar_1$ through $Ar^4$; and when k is 1, $Ar^5$ is an arylene group obtained by removing a hydrogen atom at a specific position from the aryl group represented by the aforementioned formulae (1) through (7).

Specific examples of the compound represented by formula (I) include the following compounds (I)-1 through (I)-34, but the invention is not limited to the following examples.

I-1

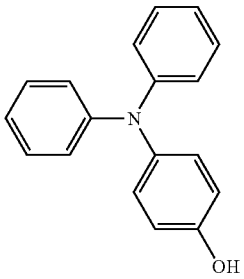

I-2

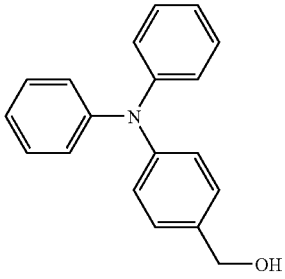

-continued

I-3

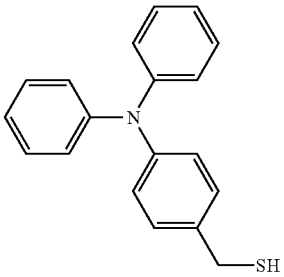

I-4

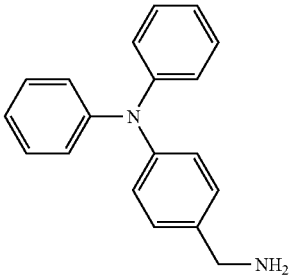

I-5

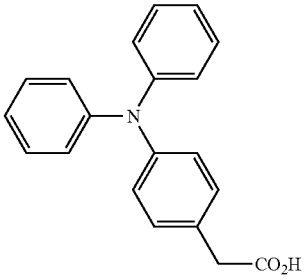

I-6

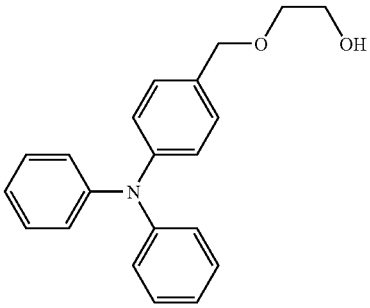

I-7

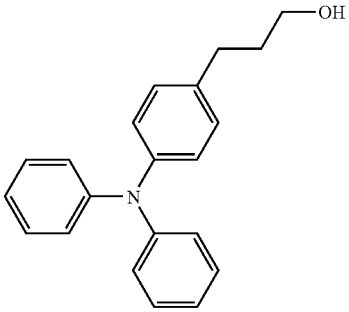

-continued
I-8
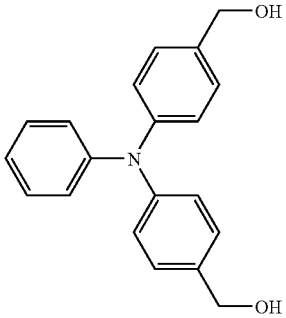
I-9
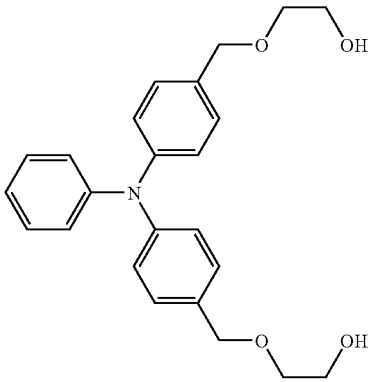
I-10
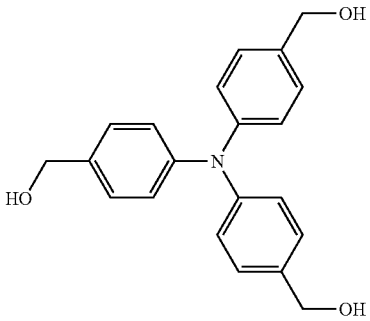
I-11
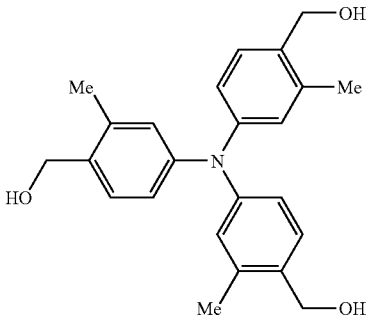
-continued
I-12
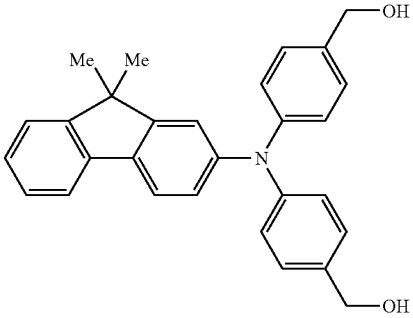
I-13
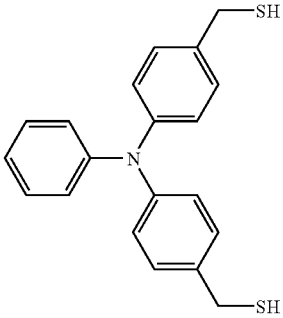
I-14
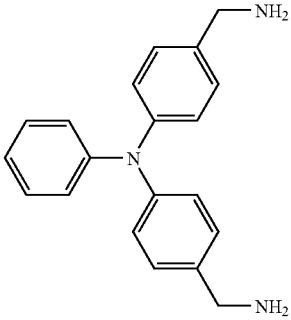
I-15
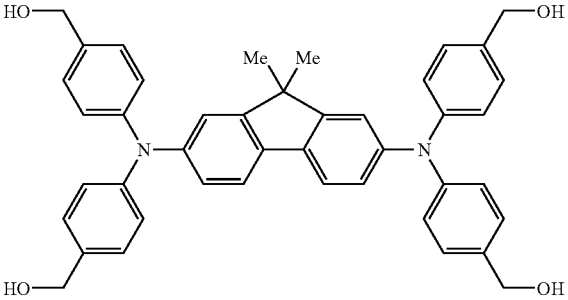
I-16
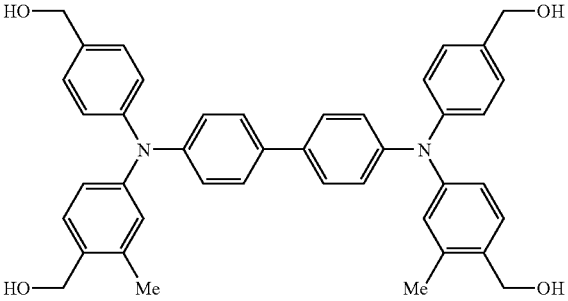

-continued
I-17
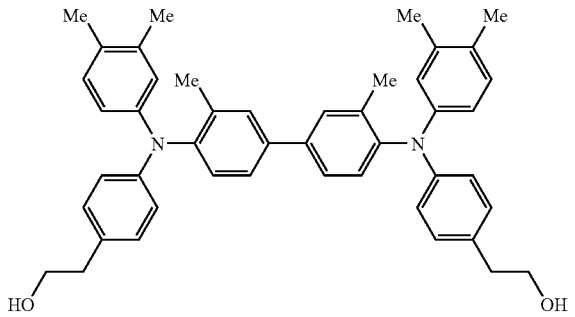
I-18
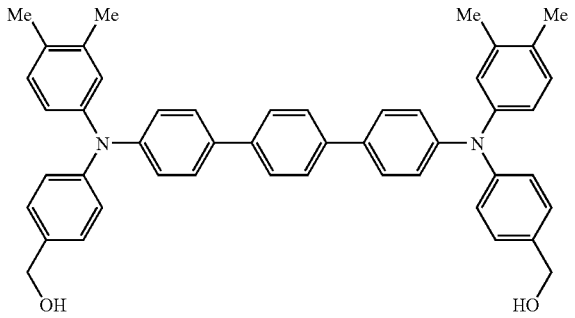
I-19
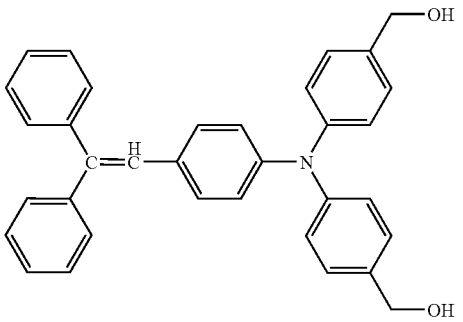
I-20
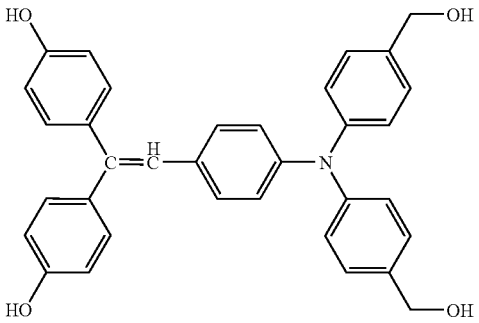
-continued
I-21
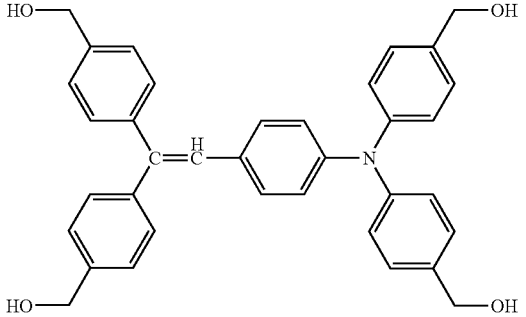
I-22
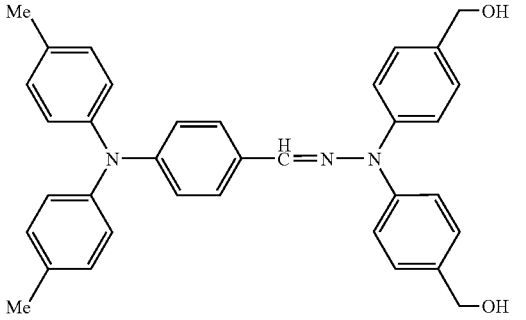
I-23
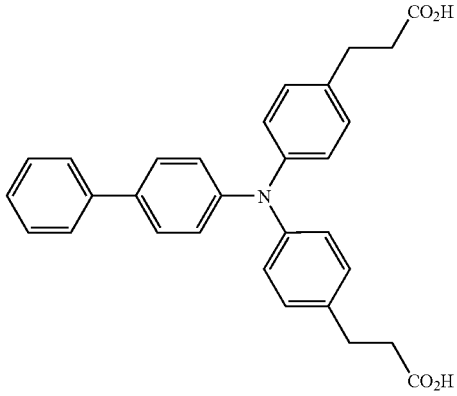
I-24
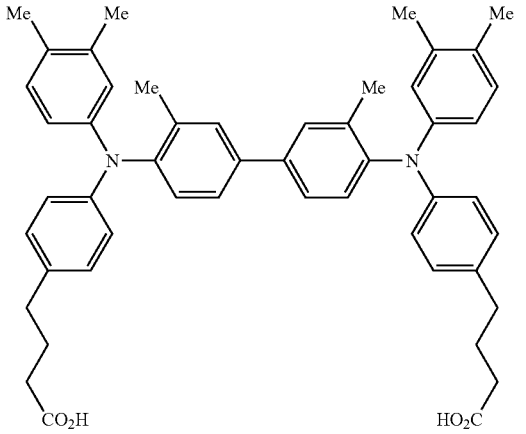

-continued
I-25
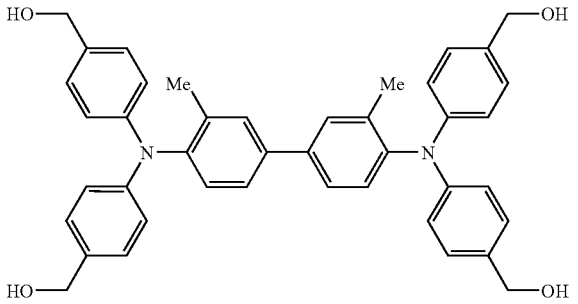
I-26
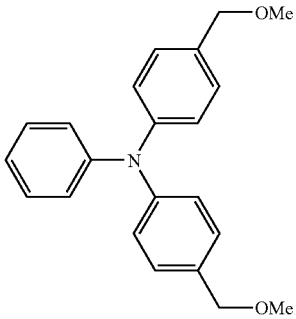
I-27
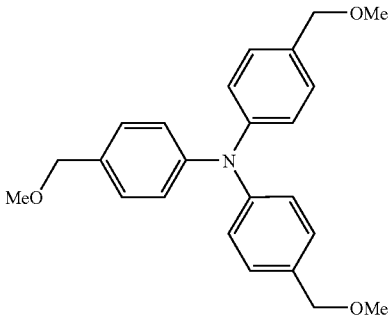
I-28
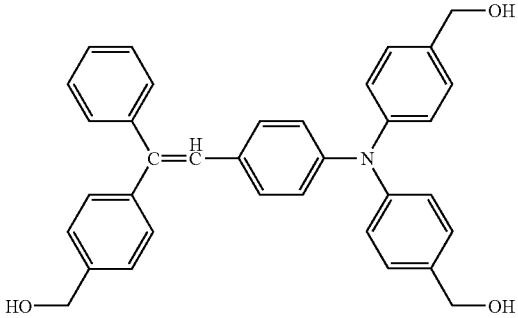
I-29
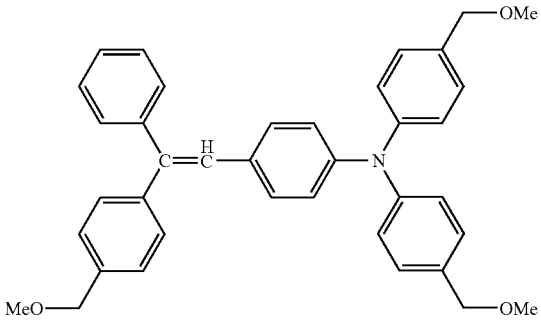
-continued
I-30
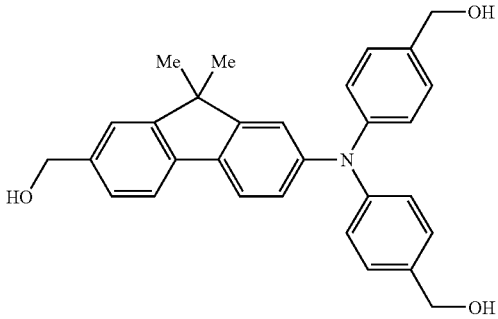
I-31
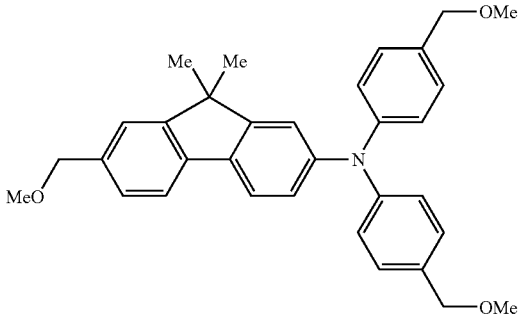
I-32
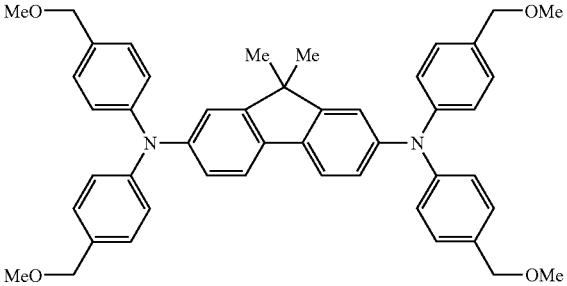
I-33
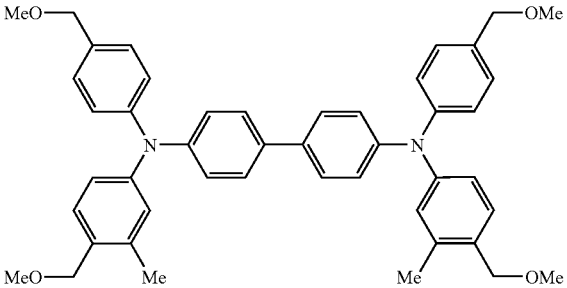
I-34
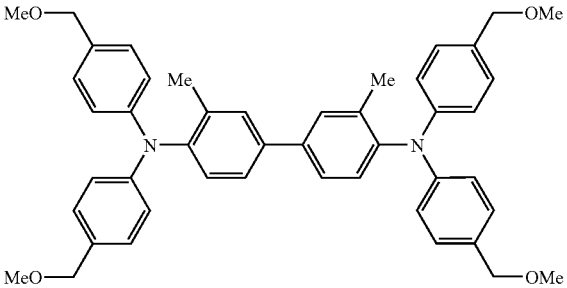

The solid content concentration of the at least one selected from a guanamine compound (the compound represented by formula (A)) or a melamine compound (the compound represented by formula (B)) in a coating solution is preferably from 0.1% by weight, or about 0.1% by weight, to 5% by weight, or about 5% by weight, and more preferably from 1% by weight to 3% by weight. When the solid content concentration is less than the above range, a film with a dense structure may not be formed and sufficient strength may not be obtained. When the solid content concentration is over the above range, electric characteristics or anti-ghost properties may deteriorate.

The solid content concentration of the at least one specific charge transporting material in the coating solution is 90% by weight or more, or about 90% by weight or more, and preferably 94% by weight or more. When the solid content concentration is less than the above range, electric characteristics may deteriorate. The upper range of the solid content concentration of the at least one specific charge transporting material is not particularly limited as long as the at least one selected from the guanamine compound or the melamine compound or other additives may effectively work, and it is more preferable to include the specific charge transporting material in a larger amount.

In the following, the protective layer 5 will be further illustrated. The protective layer 5 may include, in combination with a crosslinked product formed from at least one selected from the guanamine compound (the compound represented by formula (A)) or the melamine compound (the compound represented by formula (B)) and at least one of the specific charge transporting material, a phenolic resin, a melamine resin, an urea resin, an alkyd resin, or the like. In order to improve the strength of the protective layer 5, it is also effective to copolymerize a compound having more functional groups in one molecule, such as a spiroacetal guanamine resin (for example, CTU-GUANAMINE, trade name, manufactured by Ajinomoto-Fine-Techno Co., Inc.), with the material in the crosslinked product.

In order to prevent excess adsorption of a gas generated by discharge, the protective layer 5 may include other thermosetting resins such as a phenolic resin, a melamine resin, or a benzoguanamine resin, from the viewpoint of effectively preventing oxidation due to the gas generated by discharge.

The protective layer 5 of the invention may further include a surfactant. The surfactant is not particularly limited as long as the surfactant includes at least one of a fluorine atom, an alkylene oxide structure or a silicone structure, but surfactants having two or more of these structures are preferable from the viewpoint of obtaining higher compatibility or mutual solubility with a charge transporting organic compound and improving the film forming property of the coating solution for the protective layer, thereby suppressing wrinkles or unevenness of the protective layer 5.

There are various kinds of the surfactants containing a fluorine atom, and specific examples of the surfactant containing a fluorine atom and an acrylic structure include POLYFLOW KL600 (trade name, manufactured by Kyoeisha Chemical Co., Ltd.), EF TOP EF-351, EF-352, EF-801, EF-802 and EF-601 (trade name, manufactured by JEMCO Inc.). The surfactants having an acrylic structure include those obtained by polymerizing or copolymerizing a monomer having an acrylic or methacrylic structure.

Specific examples of the surfactant having a perfluoroalkyl group include perfluoroalkyl sulfonic acids (such as perfluorobutane sulfonic acid and perfluorooctane sulfonic acid), perfluoroalkyl carboxylic acids (such as perfluorobutane carboxylic acid and perfluorooctane carboxylic acid), and perfluoroalkyl group-containing phosphoric acid esters. The perfluoroalkyl sulfonic acids and the perfluoroalkyl carboxylic acids may be in the form of a salt or an amide-modified product thereof.

Commercially available products of the perfluroalkyl sulfonic acids include MEGAFAC F-114 (trade name, manufactured by DIC Corporation), EF TOP EF-101, EF-102, EF-103, EF-104, EF-105, EF-112, EF-121, EF-122A, EF-122B, EF-122C and EF-123A (trade name, manufactured by JEMCO Inc.) and A-K, 501 (trade name, manufactured by NEOS Corporation Limited).

Commercially available products of the perfluoroalkyl carboxylic acids include MEGAFAC F-410 (trade name, manufactured by DIC Corporation), EF TOP EF-201 and EF-204 (trade name, manufactured by JEMCO Inc.).

Commercially available products of the perfluoroalkyl group-containing phosphoric acid esters include MEGAFAC F-493 and F-494 (trade name, manufactured by DIC Corporation), EF-TOP EF-123A, EF-123B, EF-125M and EF-132 (trade name, manufactured by JEMCO Inc.).

Surfactants having an alkylene oxide structure include polyethylene glycol, polyether antifoaming agents, and polyether-modified silicone oil.

The polyethylene glycol preferably has a number average molecular weight of 2000 or less, such as polyethylene glycol 2000 (number average molecular weight: 2000), polyethylene glycol 600 (number average molecular weight: 600), polyethylene glycol 400 (number average molecular weight: 400) and polyethylene glycol 200 (number average molecular weight: 200).

Commercially available products of the polyether antifoaming agents include PE-M and PE-L (trade name, manufactured by Wako Pure Chemical Industries, Ltd.), SHOHOZAI (antifoaming agent) Nos. 1 and 5 (trade name, manufactured by Kao Corporation).

The surfactants having a silicone structure include ordinary silicone oils such as dimethyl silicone, methylphenyl silicone, diphenyl silicone and derivatives thereof.

The surfactants having both of a fluorine atom and an alkyleneoxide structure include those having an alkyleneoxide structure or a polyalkylene structure in a side chain thereof and those having an alkyleneoxide structure or a polyalkyleneoxide structure having the terminal thereof substituted by a fluorine atom-containing group. Specific examples of the surfactant having an alkylenoxide structure include MEGAFAC F-443, F-444, F-445 and F-446 (trade name, manufactured by DIC Corporation) and POLY FOX PF636, PF6320, PF6520 and PF 656 (trade name, manufactured by Kitamura Chemicals Co., Ltd.).

The surfactants having both of an alkyleneoxide structure and a silicone structure include KF 351(A), KF 352(A), KF 353(A), KF 354(A), KF 355(A), KF 615(A), KF 618, KF 945(A) and KF 6004 (trade name, manufactured by Shin-Etsu Chemical Co., Ltd.), TSF 4440, TSF 4445, TSF 4450, TSF 4446, TSF 4452, TSF 4453 and TSF 4460 (trade name, manufactured by Momentive Performance Materials Inc.), BYK-300, 302, 306, 307, 310, 315, 320, 322, 323, 325, 330, 331, 333, 337, 341, 344, 345, 346, 347, 348, 370, 375, 377 and 378, UV 3500, UV 3510 and UV 3570 (trade name, manufactured by BYK Japan KK).

The content of the surfactant is preferably from 0.01% by weight to 1% by weight and more preferably from 0.02% by weight to 0.5% by weight, with respect to the total solid content of the protective layer 5. When the content of the surfactant is 0.01% by weight or more, wrinkles or unevenness may be suppressed and effects of preventing defects in the coating film may be improved. When the content of the surfactant is 1% by weight or less, separation of the surfactant from the curable resin may be suppressed and the strength of the obtained cured product may be maintained.

The protective layer 5 may include other coupling agents or fluorine compounds in combination, in order to control film-forming ability, flexibility, lubricity, adhesiveness or the like of the film. Examples of such compounds include various silane coupling agents, and commercially available silicone-based hard coating agents.

Examples of the silane coupling agents include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane and dimethyldimethoxysilane. Examples of the commercially available hard coating agent include KP-85, X-40-9740 and X-8239 (manufactured by Shin-Etsu Chemical Co., Ltd.), AY42-440, AY42-441 and AY49-208 (manufactured by Toray Dow Corning Silicone Co. Ltd.). In order to impart water repellency, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane, may be added. The amount of the silane coupling agent may be determined as appropriate. However, the amount of the fluorine-containing compound is preferably not more than 0.25 times by weight with respect to the fluorine-free compound. If the amount of the fluorine-containing compound exceeds the above range, the film-forming ability of the crosslinked film may be impaired.

Resins that are soluble in alcohols may also be added to the protective layer 5 for the purposes of controlling the discharge gas resistance, mechanical strength, scratch resistance, particle dispersibility and viscosity; reducing the amount of the torque, controlling abrasive wear, extending the pot life, and the like.

The alcohol-soluble resin means a resin that can dissolve in an alcohol having 5 or less carbon atoms in an amount of 1% by weight or more.

Examples of the resins that are soluble in an alcohol-based solvent include polyvinylbutyral resins, polyvinylformal resins, polyvinylacetal resins such as partially acetalized polyvinylacetal resins formed by partially modifying butyral with formal or acetoacetal (for example, S-LEC B and K SERIES, trade name, manufactured by Sekisui Chemical Co., Ltd.), polyamide resins, cellulose resins and polyvinylphenolic resins. Among these, polyvinyl acetal resins and polyvinylphenolic resins are most preferable from the viewpoint of electrical characteristics. The weight average molecular weight of the resin is preferably from 2,000 to 100,000, and more preferably from 5,000 to 50,000. When the molecular weight of the resin is less than 2,000, sufficient effects due to addition of the resin may not be obtained, and when exceeds 100,000, solubility of the resin may decrease to limit the amount of the resin to dissolve, and further the film forming ability during application may deteriorate. The content of the resin is preferably from 1 to 40% by weight, more preferably from 1 to 30% by weight, and further preferably from 5 to 20% by weight. When the content of the resin is less than 1% by weight sufficient effects may not be achieved by adding the resin, and when exceeds 40% by weight, image blurring may occur at high temperature and high humidity (for example, at 28° C. and 85% RH).

In order to prevent deterioration of the protective layer 5 caused by an oxidizing gas such as ozone, which is generated by a charging device, it is preferable to add an antioxidant to the protective layer 5. As the mechanical strength on the surface of the electrophotographic photoreceptor is increased and an operating life is extended, the period of time in which the electrophotographic photoreceptor is in contact with an oxidizing gas is increased, and thus a higher degree of resistance to oxidization than ever is required. Preferable examples of the antioxidants include hindered phenol-based or hindered amine-based antioxidants, and known antioxidants such as organic sulfur-based antioxidant, phosphite-based antioxidants, dithiocarbamate-based antioxidants, thiourea-based antioxidants and benzimidazole-based antioxidants may also be used. The content of the antioxidant is preferably 20% by weight or less, and more preferably 10% by weight or less.

Examples of the hindered phenol-based antioxidant include 2,6-di-t-butyl-4-methylphenol, 2,5-di-t-butylhydroquinone, N,N'-hexamethylene bis(3,5-di-t-butyl-4-hydroxyhydrocinnamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenylacrylate, and 4,4'-butylidenebis(3-methyl-6-t-butylphenol).

In order to decrease the residual potential or improve the strength, the protective layer 5 may include particles of various kinds. One example of the particles is silicon-containing particles. The silicon-containing particles include silicon as a constituent element, and specific examples thereof include colloidal silica and silicone particles. The colloidal silica used as silicon-containing particles is a dispersion in which silica particles having an average particle diameter of from 1 nm to 100 nm, preferably from 10 nm to 30 nm are dispersed in an acidic or alkaline aqueous solvent, or in an organic solvent such as alcohol, ketone or ester. The colloidal silica may be a commercially available product. The solid content of the colloidal silica in the protective layer 5 is not particularly limited, but preferably from 0.1% by weight to 50% by weight, and more preferably from 0.1% by weight to 30% by weight, with respect to the total solid content of the protective layer 5 from the viewpoints of film-forming ability, electrical characteristics, and strength.

The silicone particles used as the silicon-containing particles may be selected from the common commercially available products of silicone resin particles, silicone rubber particles and silicone surface-treated silica particles. These silicone particles preferably have a spherical shape, and preferably have an average particle diameter of from 1 to 500 nm, more preferably from 10 to 100 nm. By using the silicone particles, which are chemically inactive and have excellent dispersibility to resin due to the small particle size thereof, and the amount thereof necessary to obtain sufficient characteristics is small, the surface properties of an electrophotographic photoreceptor may be improved without inhibiting the crosslinking reaction. More specifically, the silicone particles are incorporated into a strongly crosslinked structure in a uniform manner, thereby enhancing the lubricity and water repellency of the surface of the electrophotographic photoreceptor, and maintaining the favorable abrasion resistance and stain resistance over the long time. The content of the silicone particles in the protective layer 5 is preferably from 0.1 to 30% by weight, more preferably from 0.5 to 10% by weight, based on the total solid content of the protective layer 5.

Other examples of the particles include fluorine particles such as ethylene tetrafluoride, ethylene trifluoride, propylene hexafluoride, vinyl fluoride and vinylidene fluoride, particles obtained by copolymerizing a fluorine resin and a monomer having a hydroxyl group, such as those described on page 89 of "the proceeding of 8th Polymer Material Forum Lecture", and particles of semiconductive metal oxides such as ZnO—$Al_2O_3$, $SnO_2$—$Sb_2O_3$, $In_2O_3$—$SnO_2$, $ZnO_2$—$TiO_2$, ZnO—$TiO_2$, MgO—$Al_2O_3$, FeO—$TiO_2$, $TiO_2$, $SnO_2$, $In_2O_3$, ZnO, and MgO. Oils such as silicone oil may be added for similar purposes. Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

The protective layer 5 may further include a metal, a metal oxide, carbon black or the like. Examples of the metal include aluminum, zinc, copper, chromium, nickel, silver and stainless steel, and plastic particles onto which a metal such as above is vapor-deposited. Examples of the metal oxide include zinc oxide, titanium oxide, tin oxide, antimony oxide, indium oxide, bismuth oxide, tin-doped indium oxide, antimony-doped or tantalum-doped tin oxide, and antimony-doped zirconium oxide. These metals, metal oxides and carbon black may be used alone or in combination of two or more kinds. When two or more kinds thereof are used in combination, these may be simply mixed, or made into a solid solution or a fused product. The average particle diameter of the conductive particles is preferably 0.3 μm or less, particularly preferably 0.1 μm or less, from the viewpoint of transparency of the protective layer.

The protective layer 5 may include a curing catalyst for accelerating curing of the guanamine compound (the compound represented by formula (A)), melamine compound (the compound represented by formula (B)) or the charge transporting material. The curing catalyst is preferably an acid catalyst. Examples of the acid catalyst include aliphatic carboxylic acids such as acetic acid, chloroacetic acid, trichloroacetic acid, trifluoroacetic acid, oxalic acid, maleic acid, malonic acid and lactic acid; aromatic carboxylic acids such as benzoic acid, phthalic acid, terephthalic acid and trimellitic acid; and aliphatic or aromatic sulfonic acids such as methanesulfonic acid, dodecylsulfonic acid, benzenesulfonic acid, dodecylbenzenesulfonic acid, and naphthalenesulfonic acid. Among these, sulfur-containing materials are preferable.

When used as a curing catalyst, the sulfur-containing material exerts excellent functions as the curing catalyst for the guanamine compound (the compound represented by formula (A)), melamine compound (the compound represented by formula (B)) or the charge transporting material, and accelerates the curing reaction to improve the mechanical strength of the resultant protective layer 5. When a compound represented by formula (I) (including formula (II)) is used as the charge transporting material, the sulfur-containing material may also exhibit excellent functions as a dopant for the charge transporting material, and may further improve the electrical characteristics of the functional layer. As a result, an electrophotographic photoreceptor having the mechanical strength, film-forming ability and electrical characteristics, all at high levels, may be obtained.

The sulfur-containing material used as a curing catalyst is preferably one that is acidic at normal temperature (for example, at 25° C.) or after heating, and particularly preferably at least one of organic sulfonic acids and derivatives thereof, from the viewpoints of adhesiveness, ghost resistance and electrical characteristics. The presence of the catalyst in the protective layer 5 may be readily detected by XPS or the like.

Examples of the organic sulfonic acids and/or the derivatives thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid. Among these, p-toluenesulfonic acid and dodecylbenzenesulfonic acid are particularly preferable from the viewpoint of the catalytic activity and film-forming property. Organic sulfonates may also be used as long as these are capable of dissociating in the curable resin composition, to a certain extent.

By using a so-called heat latent catalyst that exhibits an increased degree of catalytic activity upon application of a temperature of a certain degree or more, both of the reduced curing temperature and the storage stability can be achieved since the catalytic activity at a temperature at which the liquid is in storage is low, while the catalytic activity at the time of curing is high.

Examples of the heat latent catalyst include microcapsules formed by coating an organic sulfone compound or the like with a polymer in the form of particles; porous compounds such as zeolite to which an acid or the like is adsorbed; heat latent protonic acid catalysts in which a protonic acid and/or a derivative thereof are blocked with a base; a protonic acid and/or a derivative thereof esterified by primary or secondary alcohol, a protonic acid and/or a derivative thereof blocked with a vinyl ether and/or a vinyl thioether; monoethyl amine complexes of boron trifluoride; and pyridine complexes of boron trifluoride.

From the viewpoint of catalytic activity, storage stability, availability and cost efficiency, the protonic acid and/or the derivative thereof that are blocked with a base are preferably used.

Examples of the protonic acid of the heat latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzene sulfonic acid, o-, m- or p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of the protonic acid derivatives include neutralized alkali metal salts or alkali earth metal salts of protonic acids such as sulfonic acid and phosphoric acid, and polymer compounds in which a protonic acid skeleton is incorporated into a polymer chain (e.g., polyvinylsulfonic acid). Examples of the base that blocks the protonic acid include amines.

The amines are classified into primary, secondary, and tertiary amines. In the invention, any of these amines may be used without limitation.

Examples of the primary amines include methylamine, ethylamine, propylamine, isopropylamine, n-butylamine, isobutylamine, t-butylamine, hexylamine, 2-ethylhexylamine, secondary butylamine, allylamine and methylhexylamine.

Examples of the secondary amines include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di(2-ethylhexyl)amine, disecondarybutylamine, diallylamine, N-methylhexylamine, 3-pipecholine, 4-pipecholine, 2,4-lupetidine, 2,6-lupetidine, 3,5-lupetidine, morpholine, and N-methylbenzylamine.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methyl morpholine, N,N-dimethylallylamine, N-methyl diallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole and N-methylpiperazine.

Examples of the commercially available products include NACURE 2501 (toluenesulfonic acid dissociation, methanol/isopropanol solvent, pH: 6.0 to 7.2, dissociation temperature: 80° C.), NACURE 2107 (p-toluenesulfonic acid dissociation, isopropanol solvent, pH: 8.0 to 9.0, dissociation temperature: 90° C.), NACURE 2500 (p-toluenesulfonic acid dissociation, isopropanol solvent, pH: 6.0 to 7.0, dissociation temperature: 65° C.), NACURE 2530 (p-toluenesulfonic acid dissociation, methanol/isopropanol solvent, pH: 5.7 to 6.5, dissociation temperature: 65° C.), NACURE 2547 (p-toluenesulfonic acid dissociation, aqueous solution, pH: 8.0 to 9.0, dissociation temperature: 107° C.), NACURE 2558 (p-toluene sulfonic acid dissociation, ethyleneglycol solvent, pH: 3.5 to 4.5, dissociation temperature: 80° C.), NACURE XP-357 (p-toluenesulfonic acid dissociation, methanol solvent, pH: 2.0 to 4.0, dissociation temperature: 65° C.), NACURE XP-386 (p-toluenesulfonic acid dissociation, aqueous solution, pH: 6.1 to 6.4, dissociation temperature: 80° C.), NACURE XC-2211 p-toluenesulfonic acid dissociation, pH: 7.2 to 8.5, dissociation temperature: 80° C.), NACURE 5225 (dodecylbenzenesulfonic acid dissociation, isopropanol solvent, pH: 6.0 to 7.0, dissociation temperature: 120° C.), NACURE 5414 (dodecylbenzenesulfonic acid dissociation, xylene solvent, dissociation temperature: 120° C.), NACURE 5528 (dodecylbenzenesulfonic acid dissociation, isopropanol solvent, pH: 7.0 to 8.0, dissociation temperature: 120° C.), NACURE 5925 (dodecylbenzenesulfonic acid dissociation, pH: 7.0 to 7.5, dissociation temperature: 130° C.), NACURE 1323 (dinonylnaphthalenesulfonic acid dissociation, xylene solvent, pH: 6.8 to 7.5, dissociation temperature: 150° C.), NACURE 1419 (dinonylnaphthalenesulfonic acid dissociation, xylene/methylisobutylketone solvent, dissociation temperature: 150° C.), NACURE 1557 (dinonylnaphthalenesulfonic acid dissociation, butanol/2-butoxyethanol solvent, pH: 6.5 to 7.5, dissociation temperature: 150° C.), NACURE X49-110 (dinonylnaphthalenedisulfonic acid dissociation, isobutanol/isopropanol solvent, pH: 6.5 to 7.5, dissociation temperature: 90° C.), NACURE 3525 (dinonylnaphthalenedisulfonic acid dissociation, isobutanol/isopropanol solvent, pH: 7.0 to 8.5, dissociation temperature: 120° C.), NACURE XP-383 (dinonylnaphthalenedisulfonic acid dissociation, xylene solvent, dissociation temperature: 120° C.), NACURE 3327 (dinonylnaphthalenedisulfonic acid dissociation, isobutanol/isopropanol solvent, pH: 6.5 to 7.5, dissociation temperature: 150° C.), NACURE 4167 (phosphoric acid dissociation, isopropanol/isobutanol solvent, pH: 6.8 to 7.3, dissociation temperature: 80° C.), NACURE XP-297 (phosphoric acid dissociation, water/isopropanol solvent, pH: 6.5 to 7.5, dissociation temperature: 90° C.), and NACURE 4575 (phosphoric acid dissociation, pH: 7.0 to 8.0, dissociation temperature: 110° C.). The above-mentioned products are all manufactured by King Industries.

These heat latent catalysts may be used alone or in combination of two or more kinds thereof.

The content of the catalyst is preferably from 0.1 to 50% by weight, most preferably from 10 to 30% by weight, with respect to the amount (the solid content concentration in the coating liquid) of the at least one selected from the guanamine compound (the compound represented by formula (A)) or the melamine compound (the compound represented by formula (B)). When the content is more than the above range, catalytic activity may not be sufficient, and when the content is less than the above range, lightfastness may not be sufficient. The lightfastness refers to a resistance against a phenomenon that when the photosensitive layer is exposed to light from outside such as a room lamp, concentration in the exposed area decreases. The reason for this is not clear, but it is thought to be due to a similar phenomenon to a light memory effect.

The protective layer 5 having the above-described structure is formed from a coating solution containing at least one selected from the guanamine compound (the compound represented by the formula (A)) or the melamine compound (the compound represented by formula (B)) and at least one kind of the specific charge transporting material. The coating solution contains components to be included in the protective layer 5, as necessary.

The coating solution may be prepared either with no solvent or with a solvent. Examples of the solvent include alcohols such as methanol, ethanol, propanol and butanol; ketones such as acetone and methyl ethyl ketone; and ethers such as tetrahydrofuran, diethyl ether and dioxane. These solvents may be used alone or as a mixture of two or more kinds thereof, and preferably have a boiling point of 100° C. or lower. It is particularly preferable to use at least one kind of solvent having a hydroxyl group (for example, an alcohol).

The amount of the solvent may be arbitrarily selected, but is usually from 0.5 parts by weight to 30 parts by weight, and preferably from 1 part by weight to 20 parts by weight, with respect to 1 part by weight of at least one selected from the guanamine compound (the compound represented by the formula (A)) or the melamine compound (the compound represented by formula (B)). When the amount of the solvent is too small, precipitation of the guanamine compound (the compound represented by the formula (A)) or the melamine compound (the compound represented by formula (B)) may easily occur.

When preparing a coating solution by bringing the above-described components into reaction, these components may be simply mixed and dissolved, but may also be heated to a temperature in a range of from room temperature (for example, 25° C.) to 100° C., preferably from 30° C. to 80° C., for a time period in a range of from 10 minutes to 100 hours, preferably from 1 hour to 50 hours. It is also preferable to apply ultrasonic vibration during heating, which may promote partial reaction to facilitate formation of a film with no coating defects and little variation in thickness.

The coating solution is applied onto the charge transport layer 3 by an ordinary method such as blade coating, Mayer bar coating, spray coating, dip coating, bead coating, air knife coating, or curtain coating. As necessary, the coating may be cured by heating at a temperature of, for example, from 100° C. to 170° C., and the protective layer 5 is thus obtained.

The coating solution may be used not only for electrophotographic photoreceptors, but also for fluorescence paints, anti-static films on glass or plastic surfaces, or the like. By using the above-mentioned coating solution, a film having excellent adhesiveness to the underlying layer may be obtained, and deterioration in performances caused by repeated use over the long term may be suppressed.

When the electrophotographic photoreceptor has a structure employing a single-layer photosensitive layer 6 (charge generating/charge transport layer), the content of the charge generating material therein is from about 10 to about 85% by weight, and preferably from 20 to 50% by weight. The content of the charge transporting material is preferably from 5 to 50% by weight. The method of forming a single-layer photosensitive layer 6 (charge generating/charge transport layer) may be similar to the method of forming the charge generating layer 2 and the charge transport layer 3. The thickness of the single-layer photosensitive layer 6 (charge generating/charge transport layer) is preferably from about 5 μm to about 50 μm, more preferably from 10 μm to 40 μm.

In the above-described exemplary embodiment, a crosslinked product formed from at lease one selected from the guanamine compound (the compound represented by formula (A)) or the melamine compound (the compound represented by formula (B)) and the specific charge transporting material (the compound represented by the formula (I)) is included in the protective layer 5. When the electrophotographic photoreceptor does not have the protective layer 5, the crosslinked product may be included, for example, in the charge transport layer serving as an outermost surface layer.

(Image Forming Apparatus and Process Cartridge)

Figure 4:
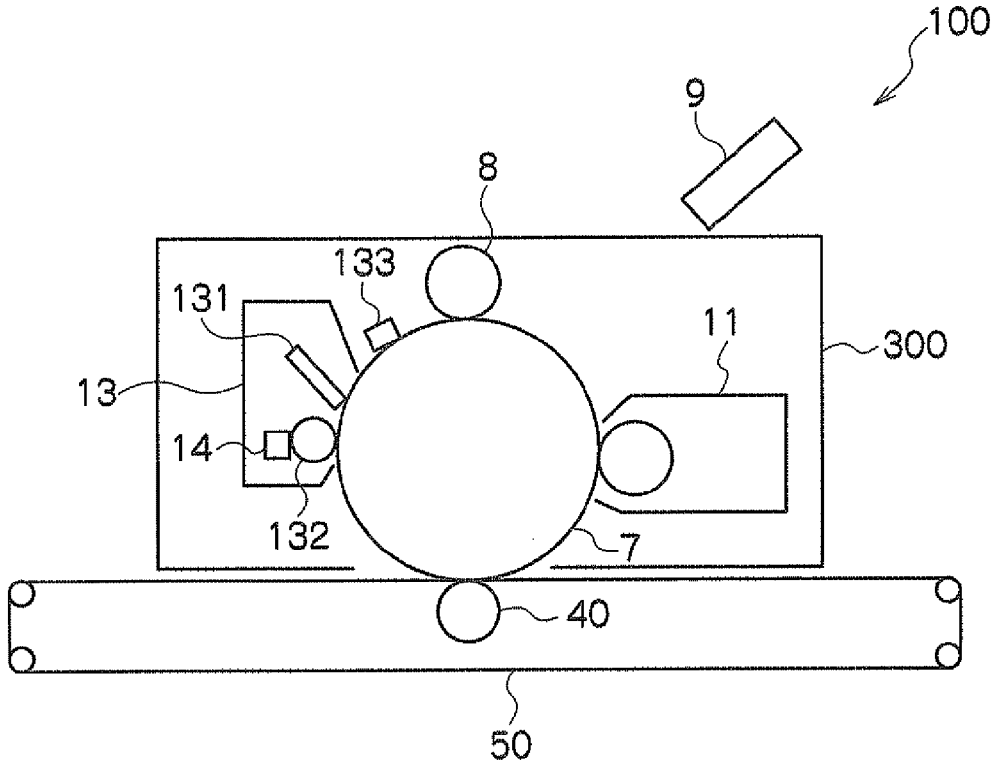
FIG. 4 is a schematic view showing an image forming apparatus according to an exemplary embodiment of the invention.

FIG. 4 is a schematic structural view of an image forming apparatus according to an exemplary embodiment of the invention. As shown in FIG. 4, the image forming apparatus 100 includes a process cartridge 300 equipped with an electrophotographic photoreceptor 7, an exposure device 9, a transfer device 40, and an intermediate transfer medium 50. In the image forming apparatus 100, the exposure device 9 is positioned such that the electrophotographic photoreceptor 7 is exposed to light through an opening of the process cartridge 300, the transfer device 40 is positioned opposite to the electrophotographic photoreceptor 7 via the intermediate transfer medium 50, and the intermediate transfer medium 50 is positioned so as to be partially in contact with the electrophotographic photoreceptor 7.

The process cartridge 300 integrally includes the electrophotographic photoreceptor 7, the charging device 8, a developing device 11 and a cleaning device 13 in a housing. The cleaning device 13 has a cleaning blade 131 (cleaning member). The cleaning blade 131 is positioned so as to be in contact with the surface of the electrophotographic photoreceptor 7.

As necessary, fibrous member 132 (roll-shaped) that supplies a lubricant 14 to the surface of the electrophotographic photoreceptor 7, and a fibrous member 133 that assists cleaning (flat brush-shaped) may be used.

As the charging device 8, for example, a contact-type charging device employing a conductive or semiconductive charging roller, a charging brush, a charging film, a charging rubber blade, a charging tube, or the like may be used. Known non contact-type charging devices such as a non contact-type roller charging device, scorotron or corotron charging devices utilizing corona discharge, or the like, may also be used.

Although not shown in the drawings, a heating member may be provided around the electrophotographic photoreceptor 7 in order to increase the temperature of the electrophotographic photoreceptor 7 to reduce the relative temperature thereof thereby improving stability of the image formation.

Examples of the exposure device 9 include optical instruments which expose the surface of the electrophotographic photoreceptor 7 to light of a semiconductor laser, an LED, a liquid-crystal shutter light or the like in a pattern of desired image. The wavelength of the light source to be used is in the range of the spectral sensitivity region of the electrophotographic photoreceptor. As the semiconductor laser light, near-infrared light having an oscillation wavelength in the vicinity of 780 nm is mainly used. However, the wavelength of the light source is not limited to the above range, and lasers having an oscillation wavelength on the order of 600 nm and blue lasers having an oscillation wavelength in the vicinity of 400 to 450 nm may also be used. Surface-emitting type laser light sources which are capable of multi-beam output are also effective in forming a color image.

As the developing device 11, for example, a common developing device that performs development by contacting or non-contacting a magnetic or non-magnetic one- or two-component developer may be used. Such developing device is not particularly limited as long as it has above-described functions, and may be appropriately selected according to the preferred use. Examples thereof include known developing device that performs development by attaching one- or two-component developer to the electrophotographic photoreceptor 7 using a brush or a roller.

A toner to be used in the developing device 11 will be described below.

The toner particles used in the image forming apparatus of the present embodiment preferably have an average shape factor ($ML^2/A\times\pi/4\times100$, wherein ML represents a maximum length of a particle and A represents a projection area of the particle.) of 100 to 150, more preferably 105 to 145, and further preferably 110 to 140 from the viewpoint of achieving high levels of developability, transferring property, and image quality. Furthermore, the volume-average particle diameter of the toner particles is preferably 3 to 12 μm, more preferably 3.5 to 10 μm, and further preferably 4 to 9 μm. By using the toner particles having the above-described average shape factor and volume-average particle diameter, developability and transferring property can be enhanced and a high quality image, so-called photographic image, can be obtained.

The method of producing the toner is not particularly limited as long as the obtained toner particles satisfy the above-described average shape factor and volume-average particle diameter Examples of the method include a kneading and grinding method in which a binder resin, a coloring agent, a releasing agent, and optionally a charge control agent or the like are mixed and kneaded, ground, and classified; a method of altering the shape of the particles obtained by the kneading and grinding method using mechanical shock or heat energy; an emulsion polymerization aggregation method in which a dispersion obtained by emulsifying and polymerizing a polymerizable monomer of a binder resin is mixed with a dispersion containing a coloring agent, a releasing agent, and optionally a charge control agent and other agents, then the mixture is subjected to aggregation, heating and fusing to obtain toner particles; a suspension polymerization method in which a polymerizable monomer used to obtain a binder resin and a solution containing a coloring agent, a releasing agent and optionally a charge control agent and other agents are suspended in an aqueous medium and subjecting the suspension to polymerization; and a dissolution-suspension method in which a binder resin and a solution containing a coloring agent, a releasing agent and optionally a charge control agent and other agents are suspended in an aqueous medium to form particles.

Moreover, known methods such as a method of producing toner particles having a core-shell structure in which aggregated particles are further attached to a core formed from the toner particles obtained by the above-described method, then heated and fused. As the method of producing toner particles, methods of producing a toner in an aqueous medium such as a suspension-polymerization method, an emulsion polymerization aggregation method, and a dissolution suspension method are preferable, and an emulsion polymerization aggregation method is most preferable from the viewpoint of controlling the shape and particle diameter distribution of the toner particles.

Toner mother particles are formed from a binder resin, a coloring agent and a releasing agent, and optionally silica or a charge control agent.

Examples of the binder resins used in the toner mother particles include monopolymers and copolymers of styrenes such as styrene and chlorostyrene, monoolefins such as ethylene, propylene, butylene and isoprene, vinyl esters such as vinyl acetate, vinyl propionate, vinyl benzoate, vinyl butyrate, a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, and polyester resins synthesized by copolymerizing a dicarboxylic acid and a diol.

Examples of the typical binder resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and polyester resins. Other examples include polyurethane, epoxy resins, silicone resins, polyamide, modified rosin and paraffin wax.

Examples of the typical coloring agents include magnetic powder such as magnetite and ferrite, carbon black, aniline blue, Calco Oil blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Examples of the typical releasing agents include low-molecular polyethylene, low-molecular polypropylene, Fischer-Tropsch wax, montan wax, carnauba wax, rice wax and candelilla wax.

As the charge control agent, known agents such as azo metal-complex compounds, metal-complex compounds of salicylic acid, and resin-type charge control agents having polar groups can be used. When toner particles are produced by a wet method, it is preferred to use materials that do not readily dissolve in water from the viewpoint of controlling ion strength and reducing the amount of contamination by waste water. The toner may be either a magnetic toner which contains a magnetic material or a non-magnetic toner which contains no magnetic material.

The toner particles used in the developing device 11 can be produced by mixing the above-described toner mother particles and external additives using a Henschel mixer, a V blender or the like.

When the toner mother particles are produced by a wet process, external additives can be added by a wet method.

Lubricant particles may be added to the toner used in the developing device 11. Examples of the lubricant particles include solid lubricants such as graphite, molybdenum disulfide, talc, fatty acids and metal salts of fatty acids, low molecular weight polyolefins such as polypropylene, polyethylene and polybutene, silicones having a softening point by heating, fatty-acid amides such as oleic acid amide, erucic acid amide, ricinoleic acid amide and stearic acid amide, vegetable waxes such as carnauba wax, rice wax, candelilla wax, Japan wax and jojoba oil, animal waxes such as beeswax, mineral and petroleum waxes such as montan wax, ozokerite, ceresine, paraffin wax, microcrystalline wax and Fischer-Tropsch wax, and modified products thereof. These may be used alone or in combination of two or more kinds thereof. The average particle diameter of the lubricant particles is preferably in the range of 0.1 to 10 μm, and those having the above-described chemical structure may be ground into particles having the same particle diameter. The content of the particles in the toner is preferably in the range of 0.05 to 2.0% by weight, more preferably 0.1 to 1.5% by weight.

Inorganic particles, organic particles, composite particles in which inorganic particles are attached to organic particles, or the like may be added to the toner particles used in the developing device 11 for the purpose of removing a deposition or a deterioration-inducing substance from the surface of the electrophotographic photoreceptor.

Examples of the appropriate inorganic particles include various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The above-described inorganic particles may be treated with a titanium coupling agent or a silane coupling agent.

Examples of the titanium coupling agents include tetrabutyl titanate, tetraoctyl titanate, isopropyltriisostearoyl titanate, isopropyltridecylbenzenesulfonyl titanate and bis(dioctylpyrophosphate)oxyacetate titanate. Examples of the silane coupling agents include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane.

The above-described inorganic particles may be subjected to a hydrophobic treatment with silicone oil or a metal salt of higher fatty acids such stearic acid aluminum, stearic acid zinc and stearic acid calcium.

Examples of the organic particles include styrene resin particles, styrene acrylic resin particles, polyester resin particles and urethane resin particles.

The diameter of the above-described particles based on the number average particle diameter is preferably 5 nm to 1000 nm, more preferably 5 nm to 800 nm, further preferably 5 nm to 700 nm. When the average particle diameter is less than the lower limit, the particles may not have sufficient abrasive properties. On the other hand, when the average particle diameter exceeds the upper limit, the particles may form scratches on the surface of the electrophotographic photoreceptor. The total content of the above-described particles and the lubricant particles is preferably 0.6% by weight or more.

As the other inorganic oxides to be added to the toner particles, it is preferable to use a combination of small inorganic oxide particles having a primary diameter of 40 nm or less and inorganic oxide particles having a larger primary average diameter than the small inorganic oxide particles, from the viewpoint of powder fluidity and charge controllability. These inorganic oxide particles may be formed from a known material, but a combination of silica particles and titanium oxide particles is preferable in order to perform precise charge control.

Dispersibility and powder fluidity of the small inorganic particles can be enhanced by conducting a surface treatment. Furthermore, addition of a carbonate such as calcium carbonate and magnesium carbonate, or an inorganic mineral such as hydrotalcite, is also preferable to remove a material generated due to discharge.

Color toner particles for electrophotography are used in combination with carriers. Examples of the carrier include iron powder, glass beads, ferrite powder, nickel powder and these powders coated with a resin. The mixing ratio of the carrier may be determined as appropriate.

Examples of the transfer device 40 include known transfer charging devices such as a contact type transfer charging devices using a belt, a roller, a film, a rubber blade, or a scorotron transfer charging device and a corotron transfer charging device utilizing corona discharge.

As the intermediate transfer body 50, a belt to which semiconductivity is imparted and made of polyimide, polyamide-imide, polycarbonate, polyarylate, polyester, rubber or the like (intermediate transfer belt) may be used. The intermediate transfer body 50 may also be in the form of a drum.

In addition to the above-described devices, the image forming apparatus 100 may further have, for example, a photodischarge device for photodischarging the electrophotographic photoreceptor 7.

Figure 5:
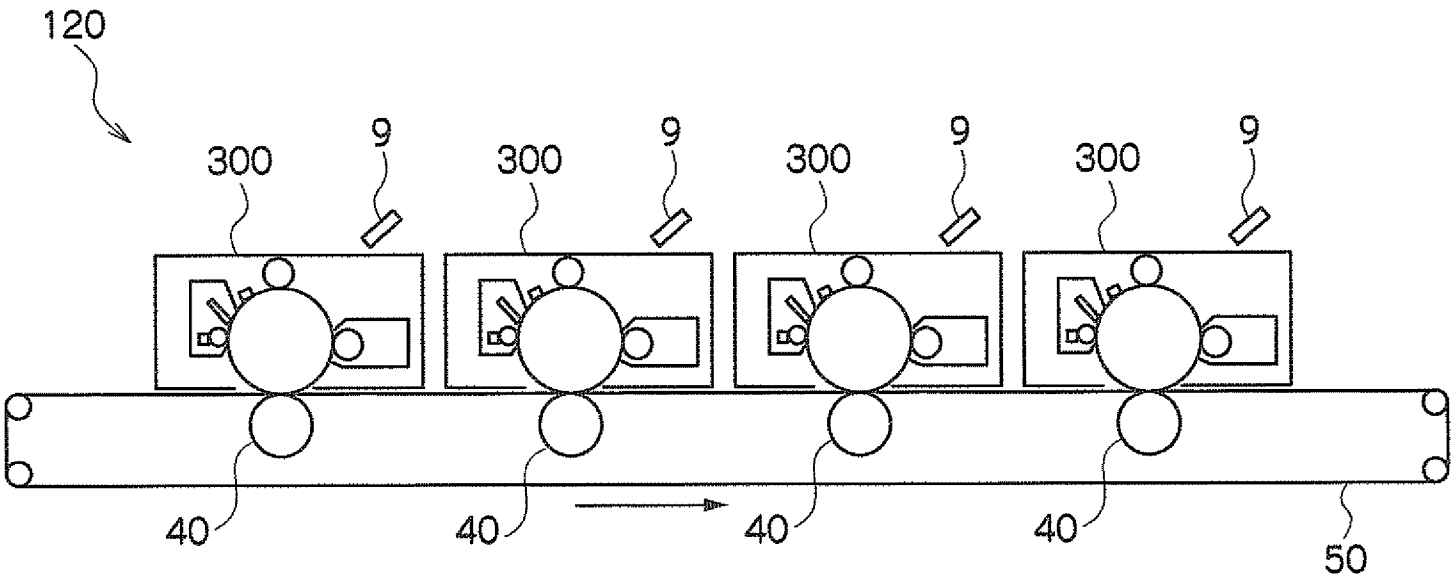
FIG. 5 is a schematic view showing an image forming apparatus according to another exemplary embodiment of the invention.

FIG. 5 is a schematic cross sectional view of an image forming apparatus 120 according to another exemplary embodiment of the invention. As shown in FIG. 5, the image forming apparatus 120 is a tandem-type full-color image forming apparatus including four process cartridges 300. In the image forming apparatus 120, four process cartridges 300 are disposed in parallel with each other on the intermediate transfer body 50, and one electrophotographic photoreceptor is used for each color. The image forming apparatus 120 has a similar constitution to the image forming apparatus 100, except that the apparatus is a tandem type.

When the electrophotographic photoreceptor of the invention is used in a tandem type image forming apparatus, electrical characteristics of the four electrophotographic photoreceptors can be stabilized, thereby enabling to obtain high image quality with excellent color balance over an even longer time.

In the image forming apparatus (process cartridge) according to this exemplary embodiment of the invention, the development apparatus (development unit) preferably includes a development roller as a developer retainer which moves (rotates) in a direction opposite to the direction (rotation direction) in which the electrophotographic photoreceptor moves. For example, the development roller has a cylindrical development sleeve for retaining the developer on the surface thereof and the development apparatus may have a control member that controls the amount of the developer to be supplied to the development sleeve.

When the development roller of the development apparatus is moved (rotated) in a direction opposite to the rotation direction of the electrophotographic photoreceptor, the surface of the electrophotographic photoreceptor is rubbed with the toner remaining between the development roller and the electrophotographic photoreceptor It is considered that the above-mentioned rubbing action and the deposition removability that has been improved by the crosslinked product formed from at least one of the guanamine compound or the melamine compound and the specific charge transporting material (in particular, the material that can provide a highly crosslinked cured film by increasing the number of the reactive functional groups), products generated by discharging (in particular, low-resistance substances derived from ozone or NOx) can be removed in an improved manner from the surface of the electrophotographic photoreceptor, and deposition of such products can be suppressed over a remarkably long term. As a result, it is considered that the defects characteristic to an electrophotographic photoreceptor having high wear resistance, such as resolution deterioration, streaks and image blurring can be suppressed, and improvements in image quality and operating life can be achieved at even higher levels. It is also considered that suppressed amount of deposition of discharge products serves to maintain excellent lubricity of the electrophotographic photoreceptor surface over the long term. Consequently, occurrence of riding up of the cleaning blade or noises may be sufficiently prevented, and a high level of cleaning performance may be maintained over the long term.

In the image forming apparatus (process cartridge) according to this exemplary embodiment of the invention, from the viewpoint of preventing deposition of discharge products over a further longer term, the space between the development sleeve and the electrophotographic photoreceptor is preferably from 200 μm to 600 μm, and more preferably from 300 μm to 500 μm. Additionally, from a similar viewpoint to the above, the space between the development sleeve and a control blade, which is a control member that controls the amount of the developer, is preferably from 300 μm to 1000 μm, and more preferably from 400 μm to 750 μm. Moreover, from the viewpoint of preventing deposition of discharge products over the longer term, an absolute value of moving velocity of the development roll surface (process speed) is preferably from 1.5 times to 2.5 times, more preferably from 1.7 times to 2.0 times, as large as an absolute value of the moving velocity of the electrophotographic photoreceptor surface.

In the image forming apparatus (process cartridge) according to an exemplary embodiment of the invention, the development apparatus (development unit) includes a developer retainer having a magnetic substance, and develops an electrostatic latent image with a developer, preferably a two-component developer containing a magnetic carrier and a toner. In this case, color images with a higher quality can be formed and a longer operating life can be achieved, as compared with the case in which a one-component developer, in particular a non-magnetic one-component developer, is used.

EXAMPLES

In the following, the invention will be illustrated in more detail with reference to the examples. However, the invention is not limited thereto.

Example A

<Guanamine Resin A1 (AG-1)>

500 parts by weight of SUPER BECKAMIN (R) L-148-55 (butyrated benzoguanamine resin, manufactured by DIC Corporation, having a structure (A)-15) is dissolved in 500 parts by weight of toluene, and this is washed for four times each with 400 ml of distilled water. The distilled water used in the final washing has a conductivity of 8 μS/cm. The solvent is distilled away under reduced pressure, and 250 parts by weight of a mizuame-like resin is obtained. The obtained resin is used as a guanamine resin A1 (AG-1). The conductivity of the washing water is measured at room temperature (about 20° C.) using a direct conductivity meter (trade name: Conductivity Meter DS-12; manufactured by Horiba, Ltd.).

<Guanamine Resin A2 (AG-2)>

500 parts by weight of SUPER BECKAMIN (R) 13-535 (methylated benzoguanamine resin, manufactured by DIC Corporation, having a structure (A)-14) is dissolved in 500 parts by weight of toluene, and this is washed for hour times each with 400 ml of distilled water. The distilled water used in the final washing has a conductivity of 8 μS/cm. The solvent is distilled away under reduced pressure, and 260 parts by weight of a mizuame-like resin is obtained. The obtained resin is used as a guanamine resin A2 (AG-2).

<Guanamine Resin A3 (AG-3)>

A commercially available guanamine resin NIKALACK BL-60 (trade name, manufactured by Nippon Carbide Industries Co., Inc., having a structure (A)-17) is used as a guanamine resin A3 (GA-3). The resin contains about 37% by weight of a xylene-based solvent.

<Melamine Resin A1 (AM-1)>

A commercially available n-butylated melamine resin UBAN 20SE60 (trade name, manufactured by Mitsui Chemicals, Inc., having a structure (B)-3, solid content: 60% by weight, solvent: xylene/n-butanol) is used as a melamine resin A1 (AM-1).

<Melamine Resin A2 (AM-2)>

A commercially available n-butylated melamine resin UBAN 122 (trade name, manufactured by Mitsui Chemicals, Inc., having a structure (B)-3, solid content: 60% by weight, solvent: n-butanol) is used as a melamine resin A2 (AM-2).

<Melamine Resin A3 (AM-3)>

A commercially available iso-butylated melamine resin UBAN 361 (trade name, manufactured by Mitsui Chemicals, Inc., having a structure (B)-7, solid content: 60% by weight, solvent: xylene/iso-butanol) is used as a melamine resin A3 (AM-3).

<Catalyst A1>

Dodecylbenzenesulfonic acid is used as catalyst A1.

<Catalyst A2>

NACURE 2107 (manufactured by King Industry) is used as catalyst A2.

<Catalyst A3>

NACURE 5225 (manufactured by King Industry) is used as catalyst A3.

<Catalyst A4>

NACURE 4167 (manufactured by King Industry) is used as catalyst A4.

<Surfactant A1>

A surfactant having both of an alkyleneoxide structure and a silicone structure BYK 302 (trade name, manufactured by BYK Japan K.K.) is used as a surfactant A1.

<Surfactant A2>

A surfactant having a fluorine atom POLYFLOW KL600 (trade name, manufactured by Kyoeisha Chemical Co., Ltd.) is used as a surfactant A2.

Example A1

An electrophotographic photoreceptor is prepared in accordance with the following process.

(Preparation of Undercoating Layer)

100 parts by weight of zinc oxide (average particle diameter: 70 nm, manufactured by Tayca Corporation, specific surface area: 15 $m^2/g$) is mixed with 500 parts by weight of toluene by stirring, and 1.3 parts by weight of a silane coupling agent (trade name: KBM503, manufactured by Shin-Etsu Chemical Co., Ltd.) is added thereto and stirred for 2 hours. Subsequently, toluene is distilled away under reduced pressure, and baking is carried out at a temperature of 120° C. for 3 hours, thereby obtaining zinc oxide with the surface treated with a silane coupling agent.

110 parts by weight of the surface-treated zinc oxide is mixed with 500 parts by weight of tetrahydrofuran by stirring, and a solution prepared by dissolving 0.6 parts by weight of alizarin to 50 parts by weight of tetrahydrofuran is added thereto, and stirred at a temperature of 50° C. for 5 hours. Subsequently, the zinc oxide to which the alizarin is added is collected by filtration under reduced pressure, and the resultant is dried at 60° C. under reduced pressure to obtain alizarin-added zinc oxide.

60 parts by weight of the above alizarin-added zinc oxide, 13.5 parts by weight of a curing agent (blocked isocyanate, trade name: SUMIDUR 3175, manufactured by Sumitomo-Bayer Urethane Co., Ltd.), 38 parts by weight of a solution prepared by dissolving 15 parts by weight of a butyral resin (trade name: S-LEC BM-1, manufactured by Sekisui Chemical Co., Ltd.) in 85 parts by weight of methyl ethyl ketone, and 25 parts by weight of methyl ethyl ketone are mixed and dispersed for 2 hours in a sand mill using glass beads having a diameter of 1 mm, thereby obtaining a dispersion.

To the obtained dispersion are added 0.005 parts by weight of dioctyltin dilaurate as a catalyst and 40 parts by weight of silicone resin particles (trade name: TOSPAL 145, manufactured by Momentive Performance Materials Inc.), thereby obtaining a coating solution for an undercoating layer. An undercoating layer having a thickness of 19 μm is formed by applying the obtained coating solution onto an aluminum substrate having a diameter of 30 mm, a length of 340 mm and a thickness of 1 mm by dip coating, and then drying to cure at a temperature of 170° C. for 40 minutes.

(Preparation of Charge Generating Layer)

A mixture of 15 parts by weight of hydroxygalliumphthalocyanine having diffraction peaks at least at 7.3°, 16.0°, 24.9° and 28.0° of Bragg angles (2θ±0.2°) in an X-ray diffraction spectrum obtained by using Cukα X rays as a charge generating material, 10 parts by weight of vinyl chloride-vinyl acetate copolymer resin (trade name: VMCH, manufactured by Nippon Unicar Co., Ltd.) as a binder resin, and 200 parts by weight of n-butyl acetate is dispersed for 4 hours in a sand mill using glass beads with a diameter of 1 mm. To the obtained dispersion are added 175 parts by weight of n-butyl acetate and 180 parts by weight of methyl ethyl ketone and stirred, thereby obtaining a coating solution for a charge generating layer. The coating solution for a charge generating layer is applied onto the undercoating layer by dip coating, and dried at an ordinary temperature (25° C.) to form a charge generating layer having a film thickness of 0.2 μm.

(Preparation of Charge Transport Layer)

45 parts by weight of

N,N'-diphenyl-N,N'-bis(3-methylphenyl)-[1,1']biphenyl-4,4'-diamine and 55 parts by weight of bisphenol Z polycarbonate resin (viscosity average molecular weight: 50,000) are dissolved in 800 parts by weight of chlorobenzene to obtain a coating solution for a charge transport layer. The coating solution is applied onto the charge generating layer, and then dried at a temperature of 130° C. for 45 minutes to form a charge transport layer having a film thickness of 20 μm.

(Preparation of Protective Layer)

2 parts by weight of guanamine resin A1 (AG-1), 97 parts by weight of a compound represented by formula (I-6), 1.7 parts by weight of 3,5-di-t-butyl-4-hydroxytoluene (BHT) as an antioxidant, 0.2 parts by weight of dodecylbenzenesulfonic acid (catalyst A1, 10% by weight with respect to guanamine resin A1), 0.1 part by weight of a leveling agent BYK-302 (manufactured by BYK Japan K.K.) and 8 parts by weight of 1-methoxy-2-propanol are mixed to obtain a coating layer for a protective layer. The obtained coating solution is applied onto the charge transport layer by dip coating and air-dried at room temperature for 30 minutes, and then heated at 150° C. for 1 hour to cure, thereby obtaining a protective layer having a thickness of about 6 μm. An electrophotographic photoreceptor of Example A1 is thus obtained.

—Image Quality Evaluation—

The electrophotographic photoreceptor prepared in accordance with the above process is installed in a printer DocuCentre Color 400CP (trade name, manufactured by Fuji Xerox Co., Ltd.), and the following evaluations are conducted in a consecutive manner at low temperature and low humidity (10° C., 15% RH).

Specifically, a 10% halftone image is printed under conditions of 10° C. and 15% RH for 5,000 times in a consecutive manner, and the quality of the 5,000th image is evaluated immediately after the printing. Subsequently, the printer is left under conditions of 10° C. and 15% RH for 24 hours, and thereafter another print test is conducted. The quality of an image that is printed for the first time is evaluated. The evaluation is performed based on the criteria as described below, and the results are shown in Table 3. In the print test, P-paper (A-3 size, manufactured by Fuji Xerox Co., Lrd.) is used.

<Ghosting>

Figure 6A:
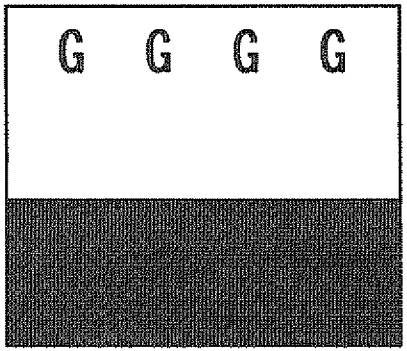
FIGS. 6A to 6C are explanatory drawings showing the criteria for evaluating ghosting.

A chart of a pattern having characters "G" in a black region as shown FIG. 6A is printed and the appearance of the characters in the black region is visually observed.

A: The characters are not observed or only slightly observed as shown in FIG. 6A.

Figure 6B:
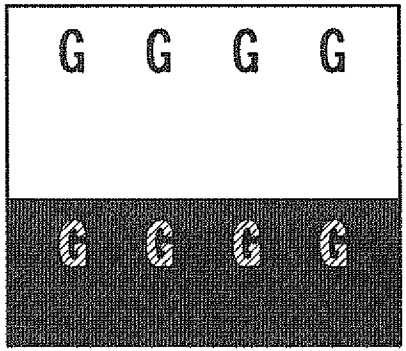

B: The characters are somewhat apparent as shown in FIG. 6B.

Figure 6C:
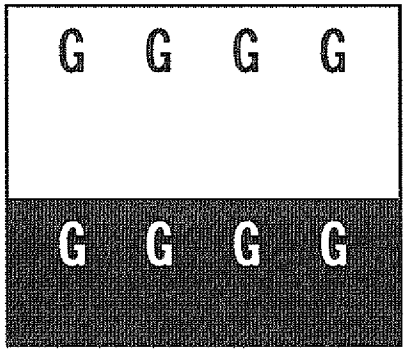

C: The characters are distinctly observed as shown in FIG. 6C.

<Image Degradation>

Occurrence of image degradation is evaluated using the same sample as that used in the above evaluation of ghosting.

A: Image degradation does not occur.

B: Image degradation does not occur during consecutive printing, but occurs after being left for 24 hours.

C: Image degradation occurs even during consecutive printing.

<Streaks>

Formation of streaks is evaluated using the same sample as that used in the above evaluation of ghosting.

A: Streaks are not formed.

B: Slight streaks are partially formed, but are acceptable for image quality.

C: Streaks which are not acceptable for image quality are formed.

—Lightfastness Evaluation—

The electrophotographic photoreceptor prepared in accordance with the above process is installed in a printer DocuCentre Color 400CP (trade name, manufactured by Fuji Xerox Co., Ltd.), and the following evaluations are conducted at high temperature and high humidity (28° C., 85% RH). The evaluation is performed based on the criteria as described below, and the results are shown in Table 3. In the print test, P-paper (A-3 size, manufactured by Fuji Xerox Co., Lrd.) is used.

(Density Reduction)

The surface of the photoreceptor is irradiated with a fluorescent room lamp of 600 Lux for 30 seconds, and the change in image density that occurs during the irradiation is visually evaluated in accordance with the following criteria.

A: No change is observed.

B: Acceptable degree of reduction in density is observed.

C: Significant reduction in density is observed.

(Density Resilience)

The electrophotographic photoreceptor used in the above test is left for a long term at high temperature and high humidity (28° C., 85% RH), and the resilience of image density is evaluated in accordance with the following criteria.

A: Density is recovered within 2 hours.

B: Density is not recovered within 2 hours, but recovered within 12 hours.

C: Density is not recovered within 12 hours.

[Film Formation Evaluation]

Presence of wrinkles or unevenness in the protective layer of the electrophotographic photoreceptor prepared in accordance with the above process is visually evaluated in accordance with the following criteria, and the results are shown in Table 3.

(Visual Observation)

The surface of the electrophotographic photoreceptor is visually observed and evaluated in accordance with the following criteria.

A: No wrinkles or unevenness is observed at a magnification of 20 times.

B: Wrinkles or unevenness is slightly observed at a magnification of 20 times.

C: Wrinkles or unevenness is observed with naked eye.

(Image Quality)

A halftone image of about 5% is formed using a magenta ink by DocuCentre Color 400CP under conditions of 20° C. and 45% RH, and the image quality is evaluated.

A: No image irregularities are observed at a magnification of 20 times.

B: Image irregularities are slightly observed at a magnification of 20 times (which may not be acceptable in the case of a machine with a strict specification).

C: Image irregularities are observed with naked eye (which is not acceptable in practical use).

Examples A2 to A24 and Comparative Examples A1 to A6

Electrophotographic photoreceptors of Examples A2 to A24 and Comparative Examples A1 to A6 are prepared in a similar manner to Example A1, by changing the ingredients and the amounts thereof as shown in Tables 1 and 2, and evaluation is conducted in a similar manner to Example A1. The results are shown in Table 3.

In Table 1 and 2, values described in parenthesis refer to a content of the catalyst with respect to the content of the guanamine resin or the melamine resin (% by weight).

TABLE 1

| | Charge Transporting Material type/parts by weight | Guanamine or Melamine Resin type/parts by weight | Antioxidant (BHT) parts by weight | Catalyst type/parts by weight | Leveling Agent (Surfactant) type/parts by weight |
|---|---|---|---|---|---|
| Example A1 | I-6/97 | AG-1/2 | 0.7 | A1/0.2 (10%) | A1/0.1 |
| Example A2 | I-2/97 | AG-1/2 | 0.1 | A2/0.8 (40%) | A1/0.1 |
| Example A3 | I-7/97 | AG-1/3 | 1.4 | A3/0.5 (17%) | A1/0.1 |
| Example A4 | I-8/92 | AG-1/5 | 4.4 | A2/0.5 (10%) | A1/0.1 |
| Example A5 | I-4/96 | AG-1/5 | 1.9 | A2/1 (20%) | A1/0.1 |
| Example A6 | I-8/98 | AG-1/3 | 0.5 | A2/0.4 (13%) | A1/0.1 |
| Example A7 | I-9/98 | AG-2/1 | 0.4 | A2/0.5 (50%) | A1/0.1 |
| Example A8 | I-9/90 | AG-2/5 | 4.2 | A2/0.7 (14%) | A1/0.1 |
| Example A9 | I-11/95 | AG-3/3 | 1.3 | A1/0.6 (20%) | A1/0.1 |
| Example A10 | I-3/97 | AG-3/2 | 0.89 | A3/0.01 (1%) | A1/0.1 |
| Example A11 | I-16/96 | AM-1/2 | 1.8 | A3/0.1 (5%) | A1/0.1 |
| Example A12 | I-19/91 | AM-1/4 | 4.6 | A3/0.3 (8%) | A1/0.1 |
| Example A13 | I-16/93 | AM-1/5 | 1.89 | A3/0.01 (0.2%) | A1/0.1 |
| Example A14 | I-19/97 | AM-1/2 | 0.75 | A3/0.05 (3%) | A1/0.2 |
| Example A15 | I-16/96 | AM-2/3 | 0.75 | A2/0.05 (2%) | A1/0.2 |

TABLE 2

| | Charge Transporting Material type/parts by weight | Guanamine or Melamine Resin type/parts by weight | Antioxidant (BHT) parts by weight | Catalyst type/parts by weight | Leveling Agent (Surfactant) type/parts by weight |
|---|---|---|---|---|---|
| Example A16 | I-19/96 | AM-2/2 | 1.75 | A2/0.05 (3%) | A1/0.2 |
| Example A17 | I-16/92 | AM-2/3 | 3.8 | A2/1 (33%) | A1/0.2 |
| Example A18 | I-25/90 | AM-3/5 | 4.9 | A2/0.01 (0.2%) | A1/0.1 |
| Example A19 | I-16/98 | AM-3/0.5 | 1.2 | A2/0.1 (20%) | A1/0.2 |
| Example A20 | I-8/94 | AM-3/5 | 0.81 | A2/0.04 (0.8%) | A1/0.15 |
| Com. Example A1 | I-6/88 | AG-1/2 | 9.7 | A2/0.2 (10%) | A1/0.1 |
| Com. Example A2 | I-6/89 | AG-1/3 | 6.2 | A2/1.7 (56.7%) | A1/0.1 |
| Com. Example A3 | I-6/85 | AG-1/4 | 8.7 | A3/2.1 (52.5%) | A1/0.2 |
| Com. Example A4 | I-6/88 | AG-2/6 | 5.8 | A2/0.005 (0.08%) | A1/0.2 |
| Com. Example A5 | I-6/89 | AG-3/7 | 3 | A3/0.9 (12.86%) | A1/0.1 |
| Com. Example A6 | I/8/98 | AM-1/0.05 | 1.8 | A3/0.01 (20%) | A1/0.14 |
| Example A21 | I-16/96 | AM-2/3 | 0.9 | A3/0.002 (0.07%) | A1/0.1 |
| Example A22 | I-16/95 | AM-3/3 | — | A2/1.8 (60%) | A1/0.2 |
| Example A23 | I-16/96 | AM-1/2 | 1.8 | A3/0.1 (5%) | A2/0.1 |
| Example A24 | I-16/96 | AM-1/2 | 1.8 | A3/0.1 (5%) | — |

TABLE 3

| | | | | | | Wrinkles or Unevenness | |
|---|---|---|---|---|---|---|---|
| | Ghosting | Image Degradation | Streaks | Density Reduction | Density Resilience | Visual Observation | Image Quality |
| Example A1 | A | A | B | A | A | A | A |
| Example A2 | A | A | B | A | A | A | A |
| Example A3 | A | A | B | A | A | A | A |
| Example A4 | A | A | A | A | A | A | A |
| Example A5 | A | A | B | A | A | A | A |
| Example A6 | A | A | A | A | A | A | A |
| Example A7 | A | A | A | A | A | A | A |
| Example A8 | A | A | A | A | A | A | A |
| Example A9 | A | A | A | A | A | A | A |
| Example A10 | A | A | A | A | A | A | A |
| Example A11 | A | A | A | A | A | A | A |
| Example A12 | A | A | A | A | A | A | A |
| Example A13 | A | A | A | A | A | A | A |
| Example A14 | A | A | A | A | A | A | A |
| Example A15 | A | A | A | A | A | A | A |
| Example A16 | A | A | A | A | A | A | A |
| Example A17 | A | A | A | A | A | A | A |
| Example A18 | A | A | A | A | A | A | A |
| Example A19 | A | A | A | A | A | A | A |
| Example A20 | A | A | A | A | A | A | A |
| Com. Ex. A1 | B | B | B | B | B | A | B |

TABLE 3-continued

| | Ghosting | Image Degradation | Streaks | Density Reduction | Density Resilience | Wrinkles or Unevenness: Visual Observation | Wrinkles or Unevenness: Image Quality |
|---|---|---|---|---|---|---|---|
| Com. Ex. A2 | B | B | B | C | C | B | C |
| Com. Ex. A3 | B | C | B | C | C | B | C |
| Com. Ex. A4 | C | B | C | B | A | B | B |
| Com. Ex. A5 | C | B | B | C | B | B | B |
| Com. Ex. A6 | A | B | B | B | A | A | B |
| Example A21 | B | B | C | B | B | A | A |
| Example A22 | B | C | A | C | B | A | A |
| Example A23 | A | A | A | A | A | A | A |
| Example A24 | A | A | B | A | A | A | B |

Example B

Example B1

(Preparation of Electrophotographic Photoreceptor)

100 parts by weight of zinc oxide (volume average particle diameter: 70 nm, manufactured by Tayca Corporation, specific surface area: 15 $m^2/g$) is mixed with 500 parts by weight of toluene by stirring, and 1.25 parts by weight of a silane coupling agent (trade name: KBM603, manufactured by Shin-Etsu Chemical Co., Ltd.) is added thereto and stirred for 2 hours. Subsequently, toluene is distilled away under reduced pressure, and baking is carried out at a temperature of 150° C. for 3 hours, thereby obtaining zinc oxide with the surface treated with a silane coupling agent.

1 part by weight of alizarin as a charge accepting material (manufactured by Aldrich Japan K.K.), 60 parts by weight of the above surface-treated zinc oxide, 13.5 parts by weight of a curing agent (blocked isocyanate, trade name: SUMIDUR 3175, manufactured by Sumitomo-Bayer Urethane Co., Ltd.), and 57 parts by weight of a solution prepared by dissolving 10 parts by weight of a butyral resin (trade name: S-LEC BM-1, manufactured by Sekisui Chemical Co., Ltd.) in 90 parts by weight of methyl ethyl ketone are mixed. The mixture is dispersed in a sand mill using glass beads having a diameter of 1 mm until the light transmission of a coating film formed from the dispersion against light having a wavelength of 950 nm reaches 25%. To the obtained dispersion are added 0.005 parts by weight of dioctyltin dilaurate as a catalyst and 9.0 parts by weight of silicone resin particles (trade name: TOSPAL 145, manufactured by GE Toshiba Silicone Co., Ltd.), thereby obtaining a coating solution for an undercoating layer. An undercoating layer having a thickness of 20 μm is formed by applying the coating solution on an aluminum substrate by dip coating, and drying to cure at a temperature of 180° C. for 30 minutes.

15 parts by weight of hydroxygalliumphthalocyanine as a charge generating material, 10 parts by weight of vinyl chloride-vinyl acetate copolymer resin (trade name: VMCH, manufactured by Nippon Unicar Co., Ltd.) as a binder resin, and 300 parts by weight of n-butyl alcohol are mixed and dispersed for 4 hours in a sand mill. The obtained coating solution for a charge generating layer is applied onto the undercoating layer by dip coating, and dried at an ordinary temperature to form a charge generating layer having a film thickness of 0.2 μm.

4 parts by weight of N,N'-diphenyl-N,N'-bis(3-methylphenyl)-[1,1']biphenyl-4,4'-diamine and 6 parts by weight of bisphenol Z polycarbonate resin (viscosity average molecular weight: 40,000) are dissolved in 21 parts by weight of tetrahydrofuran and 9 parts by weight of toluene, and 0.2 parts by weight of 2,6-di-t-butyl-4-methylphenol is further mixed thereto, thereby obtaining a coating solution for a charge transport layer. The coating solution is applied onto the charge generating layer, then dried at a temperature of 135° C. for 40 minutes to form a charge transport layer having a film thickness of 22 μm.

99 parts by weight of a charge transporting material represented by formula (I-16), 1 part by weight of a melamine compound represented by the following formula, and 0.25 parts by weight of dodecylbenzenesulfonic acid (NACURE 5225, trade name, manufactured by King Industries) are thoroughly dissolved in 350 parts by weight of cyclopentanol to obtain a coating solution for a protective layer. The obtained coating solution is applied onto the charge transport layer by dip coating, and dried at a temperature of 155° C. for 45 minutes to cure, thereby forming a protective layer having a thickness of 6.5 μm.

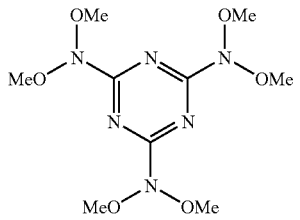

—Image Quality Evaluation: Density Irregularities—

A light-induced fatigue test is conducted using the electrophotographic photoreceptor prepared in accordance with the above process. Specifically, a portion of the electrophotographic photoreceptor is irradiated for 10 minutes with a natural white three-band fluorescent lamp (LUPICA FL15EX-N-T HL15W, trade name, manufactured by Mitsubishi Electric Osram Ltd.) such that the light intensity at the irradiated portion is about 1,000 lux.

The above electrophotographic photoreceptor is installed in a printer DocuCentre Color 1250 (trade name, manufactured by Fuji Xerox Co., Ltd.) and a 60% halftone image (black) is formed. In the obtained image, change in density in a region corresponding to the portion of the electrophotographic photoreceptor that has been subjected to irradiation is visually observed. Similar tests in which irradiation time is changed to 3 minutes and 5 minutes, respectively, are also carried out and evaluations are conducted in accordance with the following criteria. The results are shown in Table 4.

(Density Irregularities)

A: No density irregularities are observed.

B: Density irregularities are slightly observed, but are acceptable in practical use.

C: Density irregularities which may not be acceptable in practical use are slightly observed.

D: Density irregularities which are not acceptable in practical use are observed.

Example B2

An electrophotographic photoreceptor is prepared in a similar manner to Example B1 except that the light transmission with respect to light having a wavelength of 950 nm of a 20 μm-thick film formed from the dispersion for an undercoating layer is 35%. Evaluation of the obtained electrophotographic photoreceptor is conducted in a similar manner to Example B1, and the results are shown in Table 4.

Example B3

An electrophotographic photoreceptor is prepared in a similar manner to Example B1 except that the light transmission with respect to light having a wavelength of 950 nm of a 20 μm-thick film formed from the dispersion for an undercoating layer is 15%. Evaluation of the obtained electrophotographic photoreceptor is conducted in a similar manner to Example B1, and the results are shown in Table 4.

Example B4

An electrophotographic photoreceptor is prepared in a similar manner to Example B1 except that the amount of the acid catalyst in the protective layer with respect to the amount of the melamine compound is 50% by weight. Evaluation of the obtained electrophotographic photoreceptor is conducted in a similar manner to Example B1, and the results are shown in Table 4.

Example B5

An electrophotographic photoreceptor is prepared in a similar manner to Example B1 except that the melamine compound is changed to a benzoguamanine compound having a structure of (A)-13. Evaluation of the obtained electrophotographic photoreceptor is conducted in a similar manner to Example B1, and the results are shown in Table 4.

Example B6

An electrophotographic photoreceptor is prepared in a similar manner to Example B1 except that the amount of the melamine compound in the protective layer (cured layer) is 3% by weight. Evaluation of the obtained electrophotographic photoreceptor is conducted in a similar manner to Example B1, and the results are shown in Table 4.

Example B7

An electrophotographic photoreceptor is prepared in a similar manner to Example B1 except that the light transmission with respect to light having a wavelength of 950 nm of a 20 μm-thick film formed from the dispersion for an undercoating layer is 45%. Evaluation of the obtained electrophotographic photoreceptor is conducted in a similar manner to Example B1, and the results are shown in Table 4.

Example B8

An electrophotographic photoreceptor is prepared in a similar manner to Example B1 except that the light transmission with respect to light having a wavelength of 950 nm of a 20 μm-thick film formed from the dispersion for an undercoating layer is 60%. Evaluation of the obtained electrophotographic photoreceptor is conducted in a similar manner to Example B1, and the results are shown in Table 4.

Example B9

An electrophotographic photoreceptor is prepared in a similar manner to Example B1 except that the light transmission with respect to light having a wavelength of 950 nm of a 20 μm-thick film formed from the dispersion for an undercoating layer is 85%. Evaluation of the obtained electrophotographic photoreceptor is conducted in a similar manner to Example B1, and the results are shown in Table 4.

Example B10

An electrophotographic photoreceptor is prepared in a similar manner to Example B1 except that the amount of the acid catalyst in the protective layer with respect to the amount of the melamine compound is 200% by weight. Evaluation of the obtained electrophotographic photoreceptor is conducted in a similar manner to Example B1, and the results are shown in Table 4.

Example B11

An electrophotographic photoreceptor is prepared in a similar manner to Example B1 except that the amount of the melamine compound in the protective layer (cured layer) is 10% by weight. Evaluation of the obtained electrophotographic photoreceptor is conducted in a similar manner to Example B1, and the results are shown in Table 4.

TABLE 4

| | Density Irregularities Grade | | |
|---|---|---|---|
| | 1000 lux * 3 min. | 1000 lux * 5 min. | 1000 lux * 10 min. |
| Example B1 | A | A | A |
| Example B2 | A | A | B |
| Example B3 | A | A | A |
| Example B4 | A | A | B |
| Example B5 | A | B | B |
| Example B6 | A | A | A |
| Example B7 | C | C | D |
| Example B8 | C | D | D |
| Example B9 | D | D | D |
| Example B10 | C | D | D |
| Example B11 | C | C | D |

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising a conductive substrate and a photosensitive layer formed on a surface of the conductive substrate, an outermost layer of the photosensitive layer containing an antioxidant, a catalyst, a leveling agent, and a crosslinked product formed from at least one charge transporting material having at least one substituent selected from the group consisting of —OH, —OCH3, —NH2, —SH, and —COOH, and at least one selected from a guanamine compound or a melamine compound, the content of the at least one charge transporting material being at least 90% by weight, the content of the at least one selected from the guanamine compound or the melamine compound being from 0.1 by weight to 5% by weight, and the content of the catalyst being 0.1% by weight to 60% by weight with respect to the amount of the at least one selected from the guanamine compound or the melamine compound.

2. The electrophotographic photoreceptor according to claim 1, wherein the outermost layer further comprises a surfactant having at least one selected from the group consisting of a fluorine atom, an alkyleneoxide structure and a silicone structure.

3. The electrophotographic photoreceptor according to claim 1, wherein the at least one charge transporting material has at least two substituents selected from the group consisting of —OH, —$OCH_3$, —$NH_2$, —SH and —COOH.

4. The electrophotographic photoreceptor according to claim 1, wherein the at least one charge transporting material is a compound represented by the following formula (I):

$$F—((—R_1—X)_{n1}R_2—Y)_{n2} \quad (I)$$

wherein in the formula (I), F represents an organic group derived from a compound having a hole transporting ability; $R_1$ and $R_2$ each independently represent a linear or branched alkylene group having 1 to 5 carbon atoms; n1 represents 0 or 1; n2 represents an integer of 1 to 4; X represents an oxygen atom, NH, or a sulfur atom; and Y represents —OH, —$OCH_3$, —$NH_2$, —SH, or —COOH.

5. An electrophotographic photoreceptor comprising a conductive substrate and a photosensitive layer formed on a surface of the conductive substrate, an outermost layer of the photosensitive layer containing an antioxidant, a catalyst, a leveling agent, and a crosslinked product formed from a coating solution containing at least one charge transporting material having at least one substituent selected from the group consisting of —OH, —OCH3, —NH2, —SH, and —COOH, and at least one selected from a guanamine compound or a melamine compound, the solid concentration of the at least one charge transporting material in the coating solution being at least 90% by weight, and the solid content concentration of the at least one selected from the guanamine compound or the melamine compound being from 0.1 by weight to 5% by weight, and the content of the catalyst being 0.1% by weight to 60% by weight with respect to the amount of the at least one selected from the guanamine compound or the melamine compound.

6. The electrophotographic photoreceptor according to claim 5, wherein the outermost layer further comprises a surfactant having at least one selected from the group consisting of a fluorine atom, an alkyleneoxide structure and a silicone structure.

7. The electrophotographic photoreceptor according to claim 5, wherein the at least one charge transporting material has at least two substituents selected from the group consisting of —OH, —$OCH_3$, —$NH_2$, —SH and —COOH.

8. The electrophotographic photoreceptor according to claim 5, wherein the at least one charge transporting material is a compound represented by the following formula (I):

$$F—((—R_1—X)_{n1}R_2—Y)_{n2} \quad (I)$$

wherein in the formula (I), F represents an organic group derived from a compound having a hole transporting ability; $R_1$ and $R_2$ each independently represent a linear or branched alkylene group having 1 to 5 carbon atoms; n1 represents 0 or 1; n2 represents an integer of 1 to 4; X represents an oxygen atom, NH, or a sulfur atom; and Y represents —OH, —$OCH_3$, —$NH_2$, —SH, or —COOH.

9. A process cartridge comprising the electrophotographic photoreceptor according to claim 1, and at least one selected from the group consisting of a charging unit that charges the electrophotographic photoreceptor, a development unit that develops an electrostatic latent image formed on the electrophotographic photoreceptor with a toner, and a toner removal unit that removes the remaining toner from the surface of the electrophotographic photoreceptor.

10. A process cartridge comprising the electrophotographic photoreceptor according to claim 5, and at least one selected from the group consisting of a charging unit that charges the electrophotographic photoreceptor, a development unit that develops an electrostatic latent image formed on the electrophotographic photoreceptor with a toner, and a toner removal unit that removes the remaining toner from the surface of the electrophotographic photoreceptor.

11. An image forming apparatus comprising the electrophotographic photoreceptor according to claim 1, a charging unit that charges the electrophotographic photoreceptor, an electrostatic latent image forming unit that forms an electrostatic latent image on the charged electrophotographic photoreceptor, a development unit that develops the electrostatic latent image formed on the electrophotographic photoreceptor with a toner to form a toner image, and a transfer unit that transfers the toner image to an image receiving medium.

12. An image forming apparatus comprising the electrophotographic photoreceptor according to claim 5, a charging unit that charges the electrophotographic photoreceptor, an electrostatic latent image forming unit that forms an electrostatic latent image on the charged electrophotographic photoreceptor, a development unit that develops the electrostatic latent image formed on the electrophotographic photoreceptor with a toner to form a toner image, and a transfer unit that transfers the toner image to an image receiving medium.

13. The electrophotographic photoreceptor according to claim 1, wherein the at least one selected from a guanamine compound or a melamine compound is the guanamine compound.

14. The electrophotographic photoreceptor according to claim 5, wherein the at least one selected from a guanamine compound or a melamine compound is the guanamine compound.

* * * * *